US009873017B2

(12) United States Patent
Barel

(10) Patent No.: US 9,873,017 B2
(45) Date of Patent: Jan. 23, 2018

(54) APPARATUS AND METHODS FOR EXERCISING A LIMB OF A USER

(71) Applicant: Gregory Barel, Brooklyn, NY (US)

(72) Inventor: Gregory Barel, Brooklyn, NY (US)

( * ) Notice: Subject to any disclaimer, the term of this patent is extended or adjusted under 35 U.S.C. 154(b) by 0 days.

(21) Appl. No.: 14/715,274

(22) Filed: May 18, 2015

(65) Prior Publication Data

US 2016/0339296 A1 Nov. 24, 2016

(51) Int. Cl.

| | |
|---|---|
| ***A63B 23/08*** | (2006.01) |
| ***A63B 23/10*** | (2006.01) |
| ***A63B 21/055*** | (2006.01) |
| ***A63B 21/00*** | (2006.01) |
| *A63B 21/04* | (2006.01) |

(52) U.S. Cl.

CPC ..... *A63B 23/08* (2013.01); *A63B 21/0552* (2013.01); *A63B 21/0557* (2013.01); *A63B 21/4011* (2015.10); *A63B 21/4015* (2015.10); *A63B 21/4025* (2015.10); *A63B 21/4034* (2015.10); *A63B 23/10* (2013.01); *A63B 21/04* (2013.01); *A63B 21/0407* (2013.01); *A63B 2210/50* (2013.01)

(58) Field of Classification Search

CPC ..... A63B 23/08; A63B 23/10; A63B 21/0552; A63B 21/04; A63B 21/0407; A63B 21/4035

See application file for complete search history.

(56) References Cited

U.S. PATENT DOCUMENTS

| | | | | | |
|---|---|---|---|---|---|
| 2,439,100 | A * | 4/1948 | Richards | A61F 5/0127 | 602/28 |
| 3,345,067 | A * | 10/1967 | Smith | A63B 21/04 | 482/121 |
| 3,606,343 | A * | 9/1971 | Lemon | A63B 71/146 | 473/213 |
| 4,606,542 | A * | 8/1986 | Segal | A61F 5/0125 | 482/105 |
| 4,869,499 | A * | 9/1989 | Schiraldo | A61H 1/0266 | 482/124 |
| 5,215,508 | A * | 6/1993 | Bastow | A63B 23/08 | 482/112 |
| 6,503,178 | B1 * | 1/2003 | Gibbons | A63B 21/0004 | 482/121 |
| 8,114,042 | B2 * | 2/2012 | Klotz | A61F 5/0113 | 2/467 |
| 8,480,546 | B2 * | 7/2013 | Spencer | A43B 7/00 | 482/44 |
| 8,827,873 | B2 * | 9/2014 | Arnstein | A61H 1/0266 | 482/79 |
| 9,089,403 | B2 * | 7/2015 | Nace | A61F 5/0125 | |
| 9,259,343 | B2 * | 2/2016 | Newman | A61F 5/0127 | |
| 2002/0193210 | A1 * | 12/2002 | Turner | A63B 21/4047 | 482/80 |
| 2005/0192168 | A1 * | 9/2005 | Wilcocks | A63B 21/0004 | 482/124 |

(Continued)

*Primary Examiner* — Loan H Thanh
*Assistant Examiner* — Megan Anderson
(74) *Attorney, Agent, or Firm* — Van Court & Aldridge LLP

(57) ABSTRACT

At least one elastic link may be simultaneously coupled to two different portions of a limb of a user in order to provide resistance to the limb when the limb attempts to change the distance between the two different portions of the limb.

14 Claims, 18 Drawing Sheets

(56) References Cited

U.S. PATENT DOCUMENTS

| | | | | |
|---|---|---|---|---|
| 2007/0287615 | A1* | 12/2007 | Gilchrist | A63B 21/0004 482/124 |
| 2009/0131233 | A1* | 5/2009 | Seitzer | A63B 21/4015 482/105 |
| 2011/0172578 | A1* | 7/2011 | Chiu | A61F 5/0127 602/28 |

* cited by examiner

200

APPARATUS AND METHODS FOR EXERCISING A LIMB OF A USER

TECHNICAL FIELD

This disclosure relates to apparatus and methods for exercising a limb of a user and, more particularly, to apparatus and methods for exercising a limb of a user with an elastic link extending between two portions of the limb.

BACKGROUND OF THE DISCLOSURE

Exercise is an important activity in many peoples' lives. However, conventional exercise equipment is bulky and oftentimes not portable, thereby making it difficult to use throughout the course of a user's day.

SUMMARY OF THE DISCLOSURE

This document describes apparatus and methods for exercising a limb of a user.

For example, apparatus for use on a user's leg with respect to a stationary surface, wherein the user's leg includes a cnemis, a foot, and an ankle joint that couples the cnemis to the foot, the apparatus may include an anchor component operative to be coupled to the cnemis at a first cnemis location along the length of the cnemis, a base component comprising a base body extending between a first base end and a second base end, the base body operative to be positioned between the foot and the stationary surface, an extender component comprising an extender body extending between a first extender portion that is coupled to the anchor component and a second extender portion that is coupled to the base component, and a link component comprising a link body extending between a first link portion that is operative to be coupled to the anchor component and a second link portion that is operative to be coupled to the base component. When the anchor component is coupled to the cnemis at the first cnemis location and the base body is positioned between the foot and the stationary surface and the first link portion is coupled to the anchor component and the second link portion is coupled to the base component, an elastic portion of the base body is operative to provide resistance when the foot attempts to push the second base end towards the stationary surface.

As another example, a method for exercising a user's limb using exercise apparatus that includes an anchor component and a plurality of bands, wherein each band of the plurality of bands includes a band body that extends between a first band portion that is coupled to the anchor component and a second band portion, wherein the user's limb includes a first limb portion, a second limb portion, and a joint limb portion between the first limb portion and the second limb portion, and wherein the method may include coupling the anchor component to the first limb portion at a first limb position along the first limb portion, coupling the second band portion of each band of a subset of bands of the plurality of bands to a portion of the second limb portion, and, after both of the couplings, providing a resistance with the band body of each band of the subset of bands to the user's limb when the user's limb increases the distance between the first limb position and the portion of the second limb portion using the joint limb portion.

As yet another example, apparatus may be provided for use on a user's limb that includes a first limb portion, a second limb portion, and a joint limb portion between the first limb portion and the second limb portion. The apparatus may include an anchor component operative to be coupled to the first limb portion at a first limb position along the first limb portion, and a link component including a link body extending between a first link portion and a second link portion. At least a portion of the first link portion is operative to be coupled to the anchor component, at least a portion of the second link portion is operative to be coupled to the second limb portion at a second limb position along the second limb portion, the link body includes an elastic portion extending between the at least a portion of the first link portion and the at least a portion of the second link portion, and, when the anchor component is coupled to the first limb portion at the first limb position and the at least a portion of the first link portion is coupled to the anchor component and the at least a portion of the second link portion is coupled to the second limb portion at the second limb position, the elastic portion is operative to provide resistance to the user's limb when the user's limb increases the distance between the first limb position and the second limb position using the joint limb portion.

This Summary is provided merely to summarize some example embodiments, so as to provide a basic understanding of some aspects of the subject matter described in this document. Accordingly, it will be appreciated that the features described in this Summary are merely examples and should not be construed to narrow the scope or spirit of the subject matter described herein in any way. Other features, aspects, and advantages of the subject matter described herein will become apparent from the following Detailed Description, Figures, and Claims.

BRIEF DESCRIPTION OF THE DRAWINGS

The discussion below makes reference to the following drawings, in which like reference characters may refer to like parts throughout, and in which.

DETAILED DESCRIPTION OF THE DISCLOSURE

Exercise apparatus may be provided that is easy to use wherever a user may be and that is small enough to carry wherever a user may travel between uses. Such exercise apparatus may include one or more elastic links, each of which may be selectively coupled to both a first portion of a user's limb (e.g., a cnemis or shin of a leg) and a second portion of a user's limb (e.g., a foot of the leg) in order to provide resistance to the limb when the limb attempts to change the distance between the first and second portions of the limb (e.g., using an ankle joint, while the user may be sitting or standing). Different subsets of the elastic links may be coupled between the two limb portions to provide different magnitudes of resistance. When not in use, the apparatus may be reconfigured to reduce the size of the space that it occupies.

Figure 1:
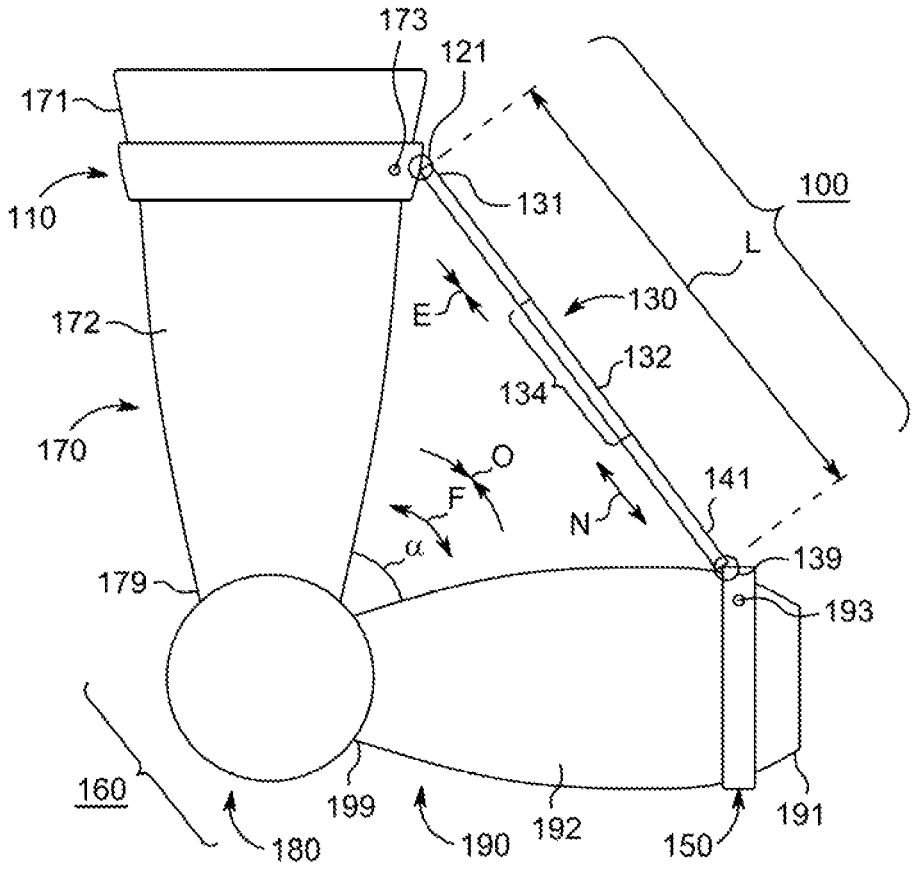
FIG. 1 is a side elevational view of a limb of a user wearing an exercise apparatus, according to some embodiments.

FIG. 1 is a side elevational view of a limb 160 of a user wearing an exercise apparatus 100, according to some embodiments in a stage of use (e.g., a stage of use where the user may be exercising any suitable portion or portions (e.g., any muscle or muscles) of limb 160 through the use of worn exercise apparatus 100). As shown in FIG. 1, limb 160 may include a first limb portion 170 having a first limb body 172 that may extend between a distal end 171 and a joint end 179, a second limb portion 190 having a second limb body 192 that may extend between a distal end 191 and a joint end 199, and a joint limb portion 180 that may be positioned between first limb portion 170 and second limb portion 190 (e.g., between joint ends 179 and 199) and/or that may couple first limb portion 170 to second limb portion 190. Limb 160 may be any suitable limb of a user, such as an arm (e.g., a left arm or a right arm) or a leg (e.g., a left leg or a right leg) of a human user. When limb 160 is an arm of a user, joint limb portion 180 may be the wrist joint of the arm, while first limb portion 170 may be the forearm of the arm, and while second limb portion 190 may be the hand of the arm. Alternatively, when limb 160 is an arm of a user, joint limb portion 180 may be the elbow joint of the arm, while first limb portion 170 may be the upper arm of the arm, and while second limb portion 190 may be the forearm of the arm. Alternatively, when limb 160 is an arm of a user, joint limb portion 180 may include both the wrist joint and the elbow joint of the arm, while first limb portion 170 may be the upper arm of the arm, and while second limb portion 190 may be the hand of the arm. When limb 160 is a leg of a user, joint limb portion 180 may be the ankle joint of the leg, while first limb portion 170 may be the cnemis of the leg, and while second limb portion 190 may be the foot of the leg. Alternatively, when limb 160 is a leg of a user, joint limb portion 180 may be the knee joint of the leg, while first limb portion 170 may be the thigh of the leg, and while second limb portion 190 may be the cnemis of the leg. Alternatively, when limb 160 is a leg of a user, joint limb portion 180 may include both the ankle joint and the knee joint of the leg, while first limb portion 170 may be the thigh of the leg, and while second limb portion 190 may be the foot of the leg.

Moreover, as shown in FIG. 1, exercise apparatus 100 may include a link component 130 operative to be coupled to an anchor component 110 and/or a base component 150. Anchor component 110 may be operative to be coupled to first limb portion 170 at any suitable anchor position or first limb position 173 along the length of first limb portion 170 (e.g., at any suitable position between ends 171 and 179). Additionally or alternatively, base component 150 may be operative to be coupled to second limb portion 190 at any suitable base position or second limb position 193 along the length of second limb portion 190 (e.g., at any suitable position between ends 191 and 199). Anchor component 110 may include any suitable element or elements that may be operative to retain anchor component 110 at first limb position 173 along first limb portion 170 throughout the exercise use of apparatus 100 by limb 160 of the user, and/or base component 150 may include any suitable element or elements that may be operative to retain base component 150 at second limb position 193 along second limb portion 190 throughout the exercise use of apparatus 100 by limb 160, where such suitable element or elements of anchor component 110 and/or of base component 150 may include, but are not limited to, one or more straps that may be secured about or otherwise to limb portion 170/190 using any suitable approach (e.g., a buckle, drawstring, phone lanyard, knot, snap fastener, hook and loop fastener (e.g., Velcro™), etc.), an elastic loop, at least a portion of an article of clothing (e.g., footwear (e.g., shoe, sandal, etc.), hand wear (e.g., glove, watch, etc.), etc.), and the like, which may provide a comfortably tight fit at least partially about or against limb portion 170/190. Link component 130 may include a link body 132 extending between a first link portion 131 and a second link portion 139. In some embodiments, first link portion 131 may be directly coupled to first limb portion 170 at first limb position 173 along first limb portion 170 (e.g., when apparatus 100 does not include an anchor component 110). Alternatively, first link portion 131 may be coupled to first limb portion 170 at first limb position 173 via anchor component 110 when anchor component 110 is coupled to first limb portion 170 at first limb position 173, where, for example, first link portion 131 may be coupled to anchor component 110 via any suitable link anchor retention mechanism(s) 121. Additionally or alternatively, in some embodiments, second link portion 139 may be directly coupled to second limb portion 190 at second limb position 193 along second limb portion 190 (e.g., when apparatus 100 does not include a base component 150). Alternatively, second link portion 139 may be coupled to second limb portion 190 at second limb position 193 via base component 150 when base component 150 is coupled to second limb portion 190 at second limb position 193, where, for example, second link portion 139 may be coupled to base component 150 via any suitable link base retention mechanism(s) 141.

Link component 130 may include at least one elastic band. In some embodiments, as described below in more detail with respect to one or more of FIGS. 2-17, the elastic band may be a closed loop, whereby first link portion 131 may be a first portion of the closed loop that may be operative to loop around first limb portion 170 for coupling to first limb portion 170 at position 173 or whereby first link portion 131 may be coupled to anchor component 110 via any suitable mechanism 121 (e.g., a first portion of the closed loop may pass through a closed ring or an at least partially closed ring mechanism 121 of anchor component 110), and/or whereby second link portion 139 may be a second portion of the closed loop that may be operative to loop around second limb portion 190 for coupling to second limb portion 190 at position 193 or whereby second link portion 139 may be coupled to base component 150 via any suitable mechanism 141 (e.g., a second portion of the closed loop may pass through a closed ring or an at least partially closed ring mechanism 141 or by looping about a portion of a hook of base component 150). In other embodiments, as described below in more detail with respect to one or more of FIGS. 2-17, the elastic band may not be a closed loop but may be an elastic band that extends between a first band end at first link portion 131 and a second band end at second link portion 139 that is distinct from the first band end, whereby first link portion 131 may be fixedly or removably coupled to anchor component 110 via any suitable mechanism 121 (e.g., a first end of the elastic band may be held with respect to a passageway mechanism 121 that is smaller than the first end), and/or whereby second link portion 139 may be fixedly or removably coupled to base component 150 via any suitable mechanism 141 (e.g., a second end of the elastic band may be held with respect to a passageway mechanism 141 that is smaller than the first end). Moreover, as described below in more detail with respect to one or more of FIGS. 2-17, link component 130 may include any suitable number of such bands, each of which may be of any suitable type, whereby varying the number of bands linking first limb portion 170 and second limb portion 190 may vary the magnitude of resistance that link component 130 may be operative to provide to an exercising limb 160 wearing apparatus 100.

At least a portion 134 of link body 132 or the entirety of link body 132 may be elastic (e.g., stretchy, elasticized, stretchable, springy, flexible, pliant, pliable, supple, yielding, resilient, etc.) or configured as any suitable material to provide any suitable elasticity (e.g., cord, tape, fabric (e.g., with rubber), etc.), such that link body 132 may be operative to have a tendency to return to an original shape after being deformed (e.g., contracted, dilated, distorted, expanded, stretched, etc.) and/or provide a resistance while being deformed. Therefore, a length L of link body 132 between first link portion 131 and second link portion 139 may be operative to vary between an original or relaxed length when no external forces are applied to link body 132 and a deformed or stressed length when any suitable external forces are applied to link body 132, where such a deformed or stressed length may be greater than or less than such an original or relaxed length (e.g., greater than if link body 132 is an elastic band whose ends 131 and 139 are stretched apart from one another beyond their original or relaxed distance (e.g., with tensile or pulling force(s)), or less than if link body 132 is an elastic spring whose ends 131 and 139 are forced closer together than their original or relaxed distance (e.g., with compressive or pushing force(s))). In some embodiments, when the user wearing apparatus 100 exercises (e.g., using joint limb portion 180) with a particular exercise motion such that an angle α formed between first limb body 172 and second limb body 192 may be increased in the direction of arrows F and such that second limb position 193 of second limb portion 190 may be pushed away from first limb position 173 of first limb portion 170 and such that link base retention mechanism(s) 141 may be pushed away from link anchor retention mechanism(s) 121 (e.g., in the direction of arrows N) to deform link body 132 (e.g., a rubber band), length L of link body 132 may likewise increase to a deformed or stressed length that may be greater than its original or relaxed length, whereby such deformation of link body 132 may be operative to provide a resistance to such exercising limb 160 of the user. Conversely, in such embodiments, when the user wearing apparatus 100 exercises (e.g., using joint limb portion 180) with an opposite exercise motion such that angle α formed between first limb body 172 and second limb body 192 may be decreased in the direction of arrows O and such that second limb position 193 of second limb portion 190 may be pulled towards first limb position 173 of first limb portion 170 and such that link base retention mechanism(s) 141 may be pulled towards link anchor retention mechanism(s) 121 (e.g., in the direction of arrows E) to underform link body 132, length L of link body 132 may likewise decrease to its original or relaxed length that may be less than its deformed or stressed length, whereby such return of link body 132 may be operative not to provide any resistance to such an exercising limb 160 of the user. Alternatively or additionally, in other embodiments, when the user wearing apparatus 100 exercises (e.g., using joint limb portion 180) with a particular exercise motion such that an angle α formed between first limb body 172 and second limb body 192 may be decreased in the direction of arrows O and such that second limb position 193 of second limb portion 190 may be pushed towards first limb position 173 of first limb portion 170 (e.g., in the direction of arrows E) to deform link body 132 (e.g., a compression spring), length L of link body 132 may likewise decrease to a deformed or stressed length that may be less than its original or relaxed length, whereby such deformation of link body 132 may be operative to provide a resistance to such exercising limb 160 of the user. Conversely, in such embodiments, when the user wearing apparatus 100 exercises (e.g., using joint limb portion 180) with an opposite exercise motion such that angle α formed between first limb body 172 and second limb body 192 may be increased in the direction of arrows F and such that second limb position 193 of second limb portion 190 may be pulled away from first limb position 173 of first limb portion 170 (e.g., in the direction of arrows N) to underform link body 132, length L of link body 132 may likewise increase to its original or relaxed length that may be greater than its deformed or stressed length, whereby such return of link body 132 may be operative not to provide any resistance to such an exercising limb 160 of the user. Therefore, coupling of each one of first link portion 131 and second link portion 139 to respective positions 173 and 193 of limb portions 170 and 190, either directly or via respective components 110 and 150, the elasticity of link body 132 may repetitively alternate the provisioning of resistance to limb 160 during repetitive exercise of limb 160 that repetitively increases and decreases the size of angle α.

Figure 2:
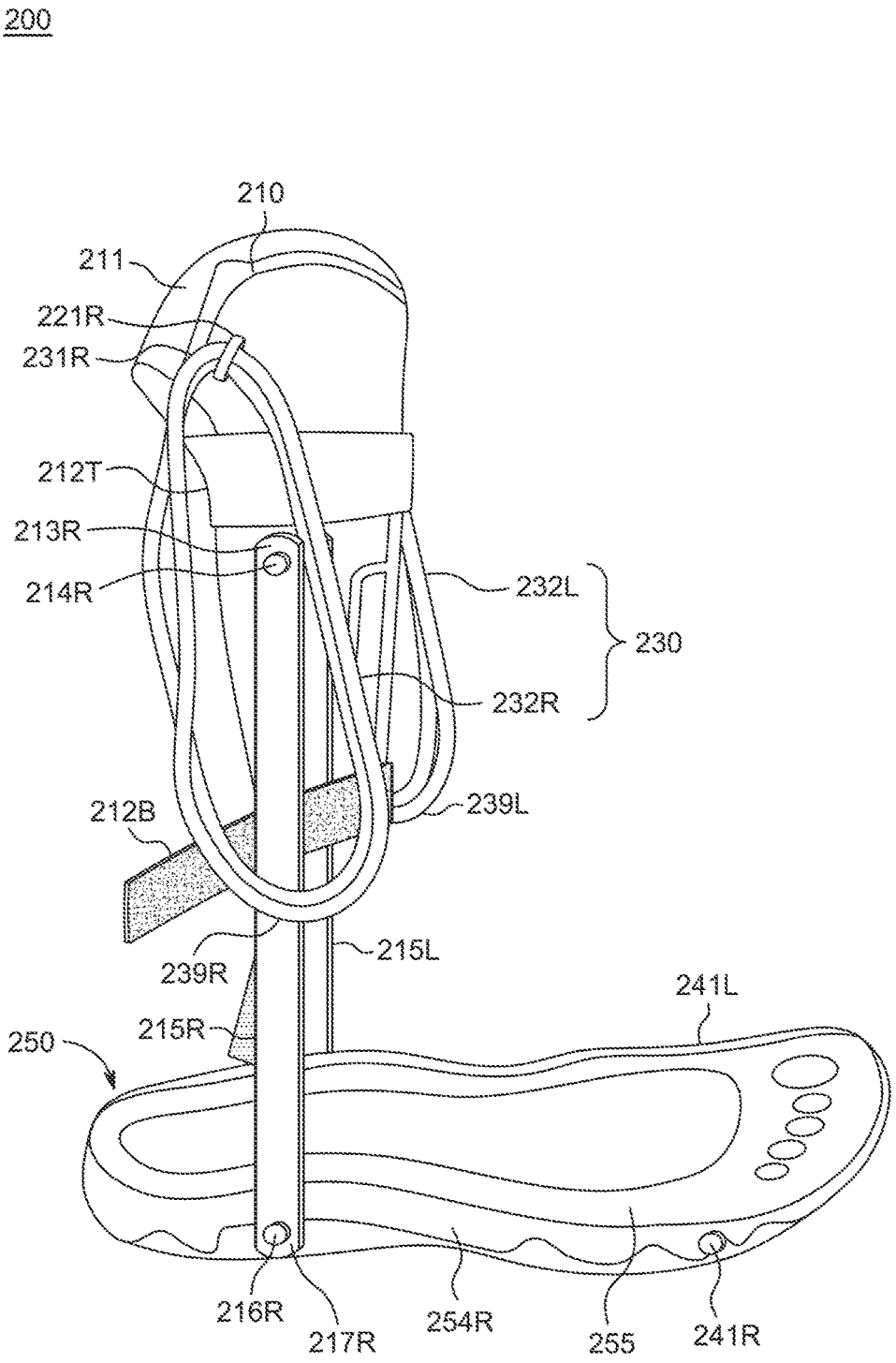
FIG. 2 is a right, top, front perspective view of an exercise apparatus, in a first stage of use, according to some embodiments.
Figure 3:
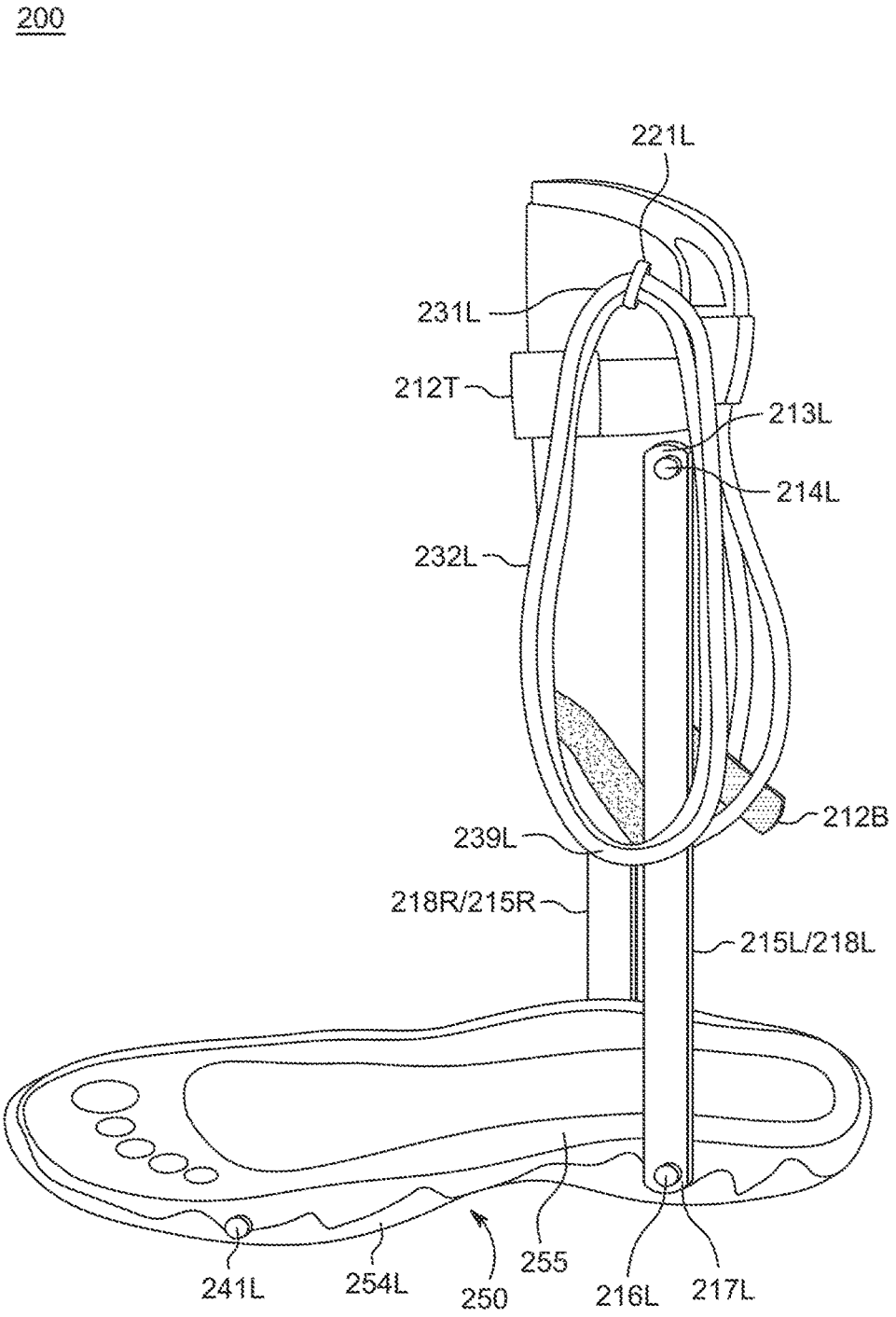
FIG. 3 is a left, top, front perspective view of the exercise apparatus of FIG. 2, in the first stage of use of FIG. 2, according to some embodiments.
Figure 4:
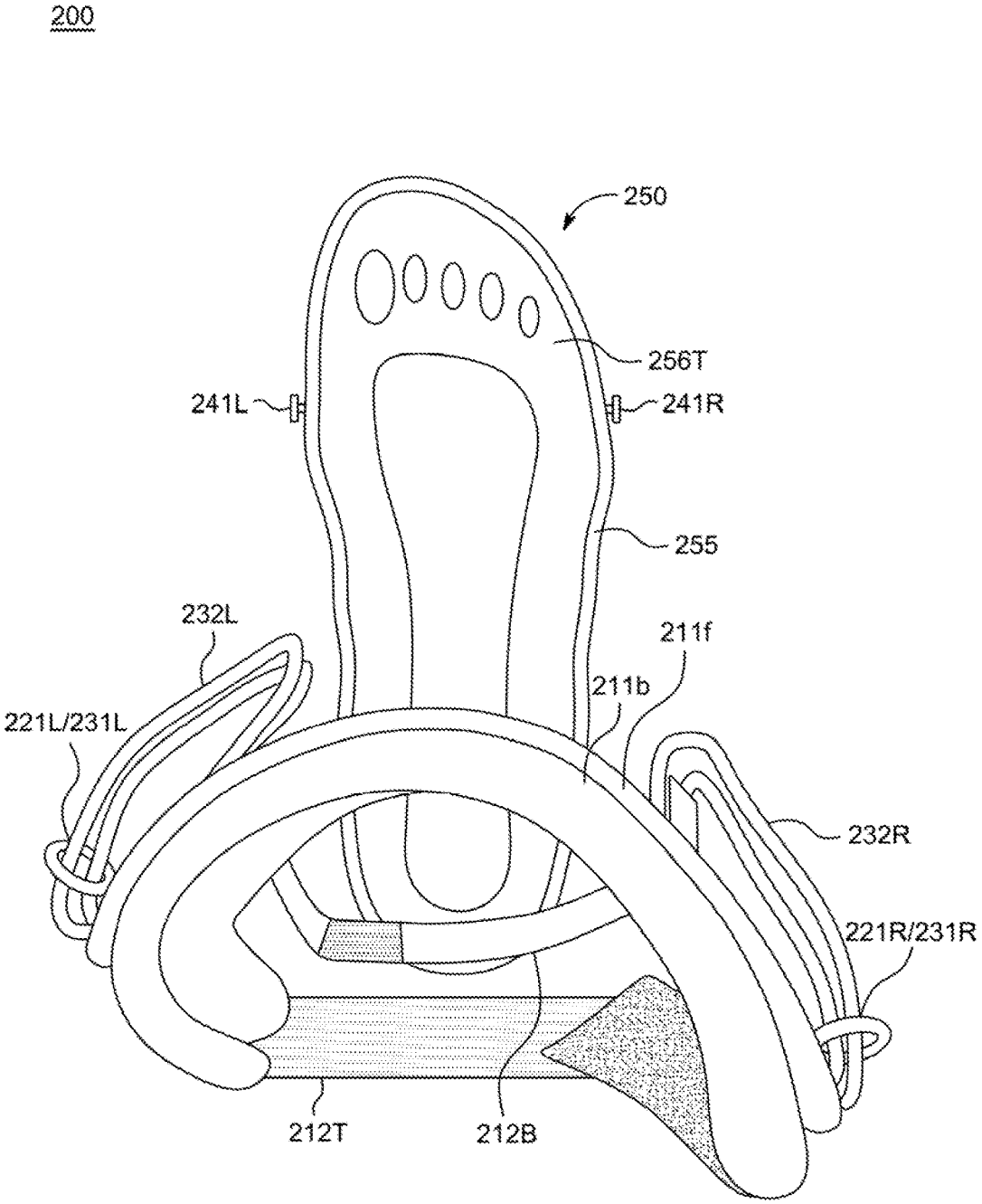
FIG. 4 is a top view of the exercise apparatus of FIGS. 2 and 3, in the first stage of use of FIGS. 2 and 3, according to some embodiments.
Figure 5:
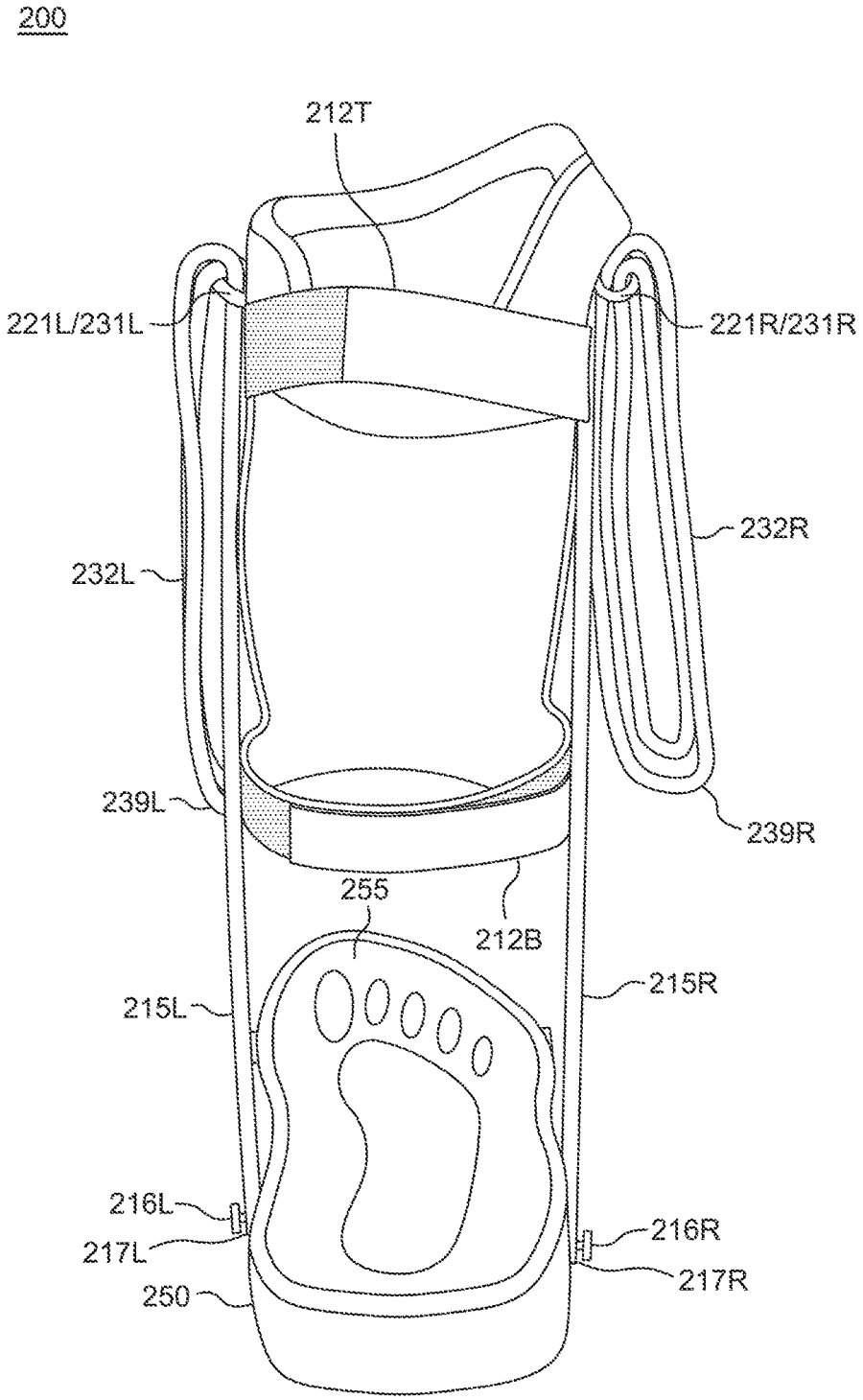
FIG. 5 is a top, back perspective view of the exercise apparatus of FIGS. 2-4, in the first stage of use of FIGS. 2-4, according to some embodiments.
Figure 6:
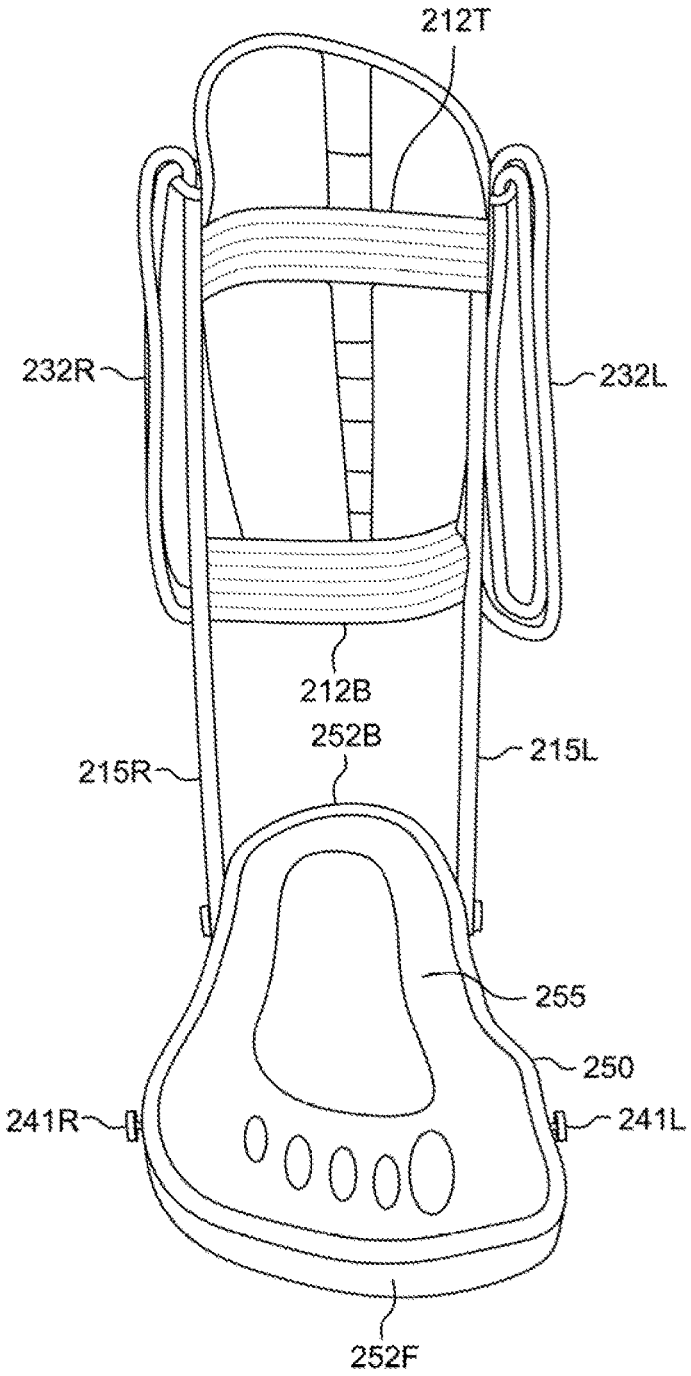
FIG. 6 is a top, front perspective view of the exercise apparatus of FIGS. 2-5, in the first stage of use of FIGS. 2-5, according to some embodiments.
Figure 7:
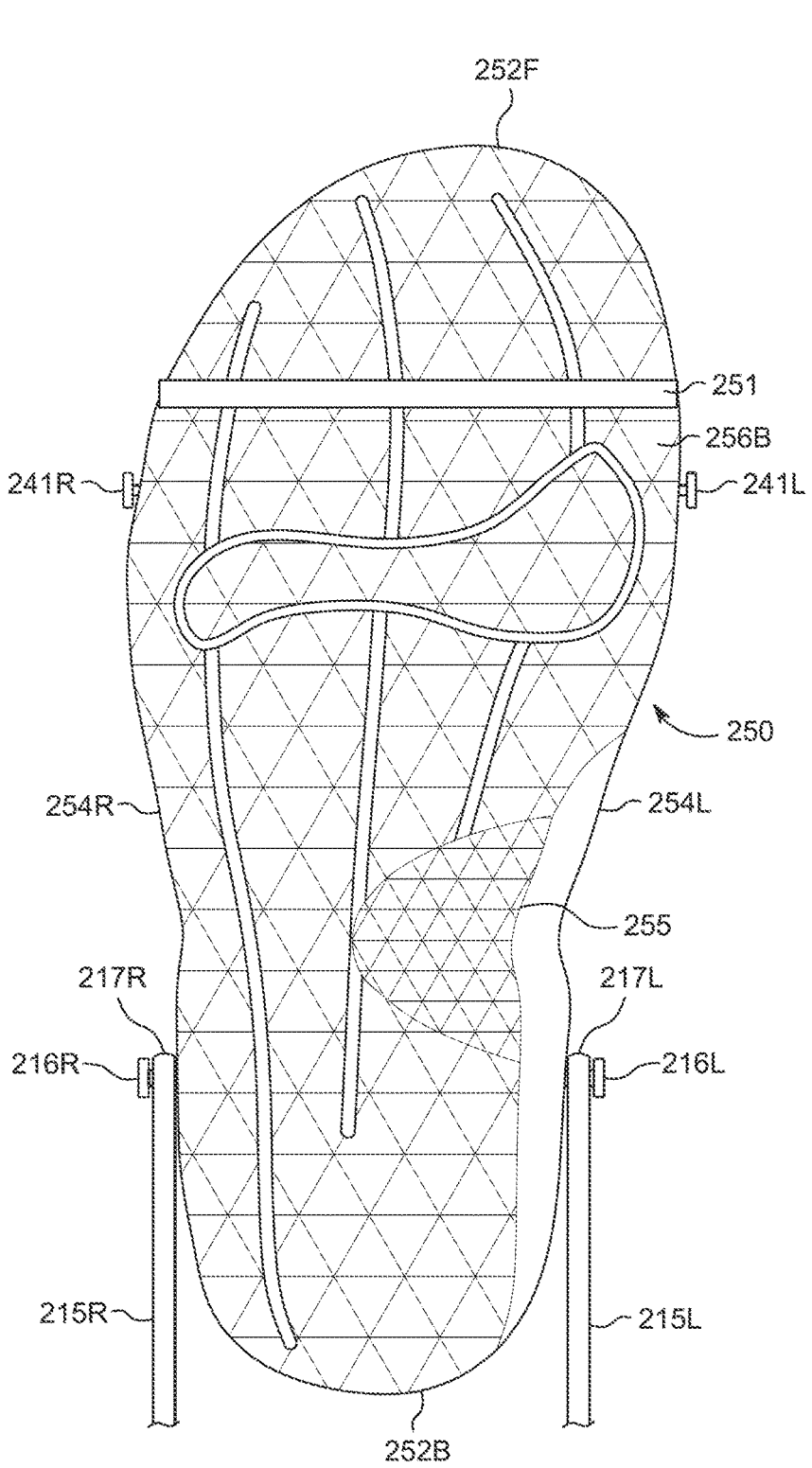
FIG. 7 is a bottom view of the exercise apparatus of FIGS. 2-6, in the first stage of use of FIGS. 2-6, according to some embodiments.
Figure 8:
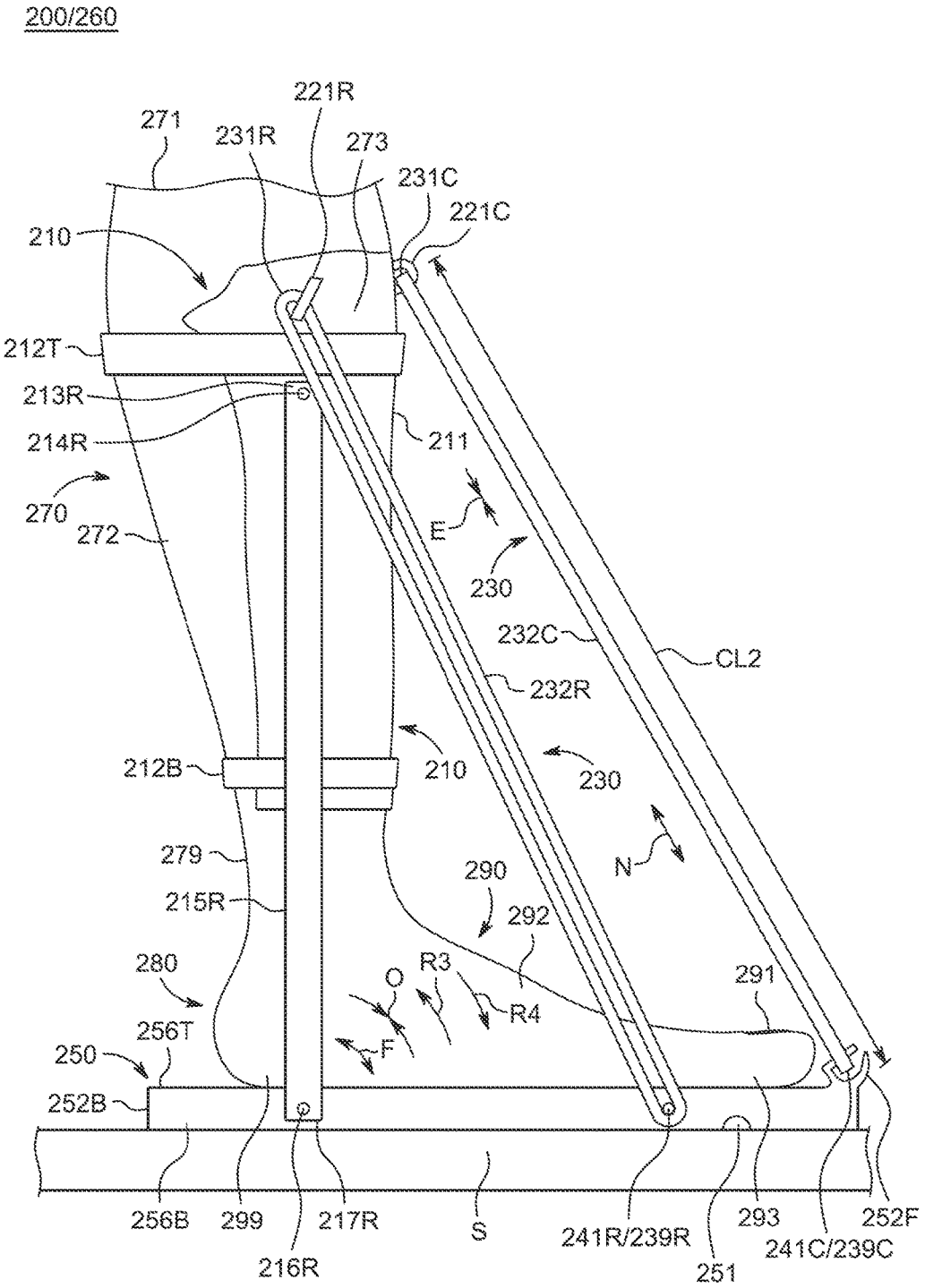
FIG. 8 is a right side elevational view of the exercise apparatus of FIGS. 2-7, but with additional features, and being worn by a user in a second stage of use, according to some embodiments.
Figure 9:
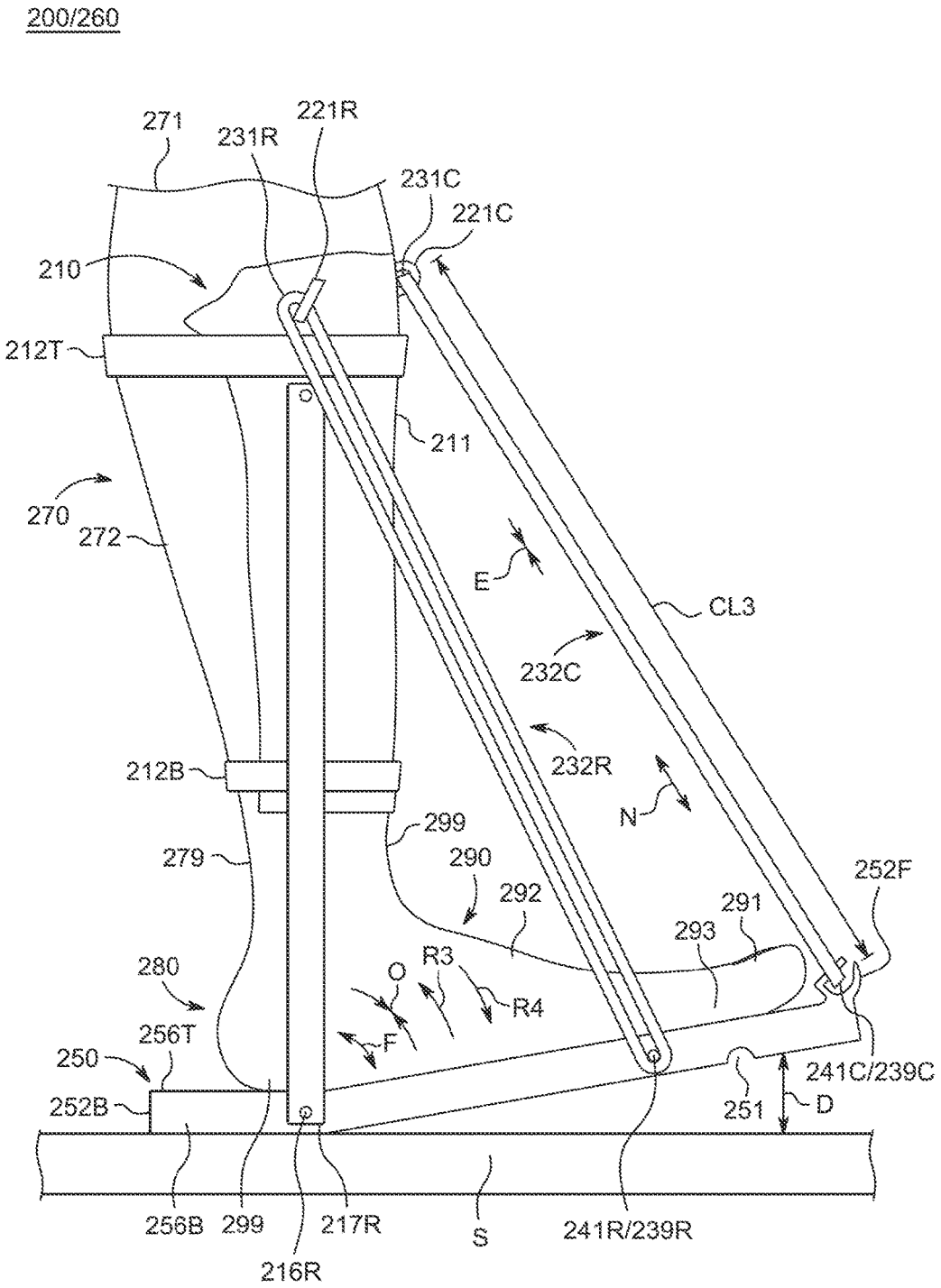
FIG. 9 is a right side elevational view, similar to FIG. 8, of the exercise apparatus of FIG. 8, but being worn by the user in a third stage of use, according to some embodiments.
Figure 10:
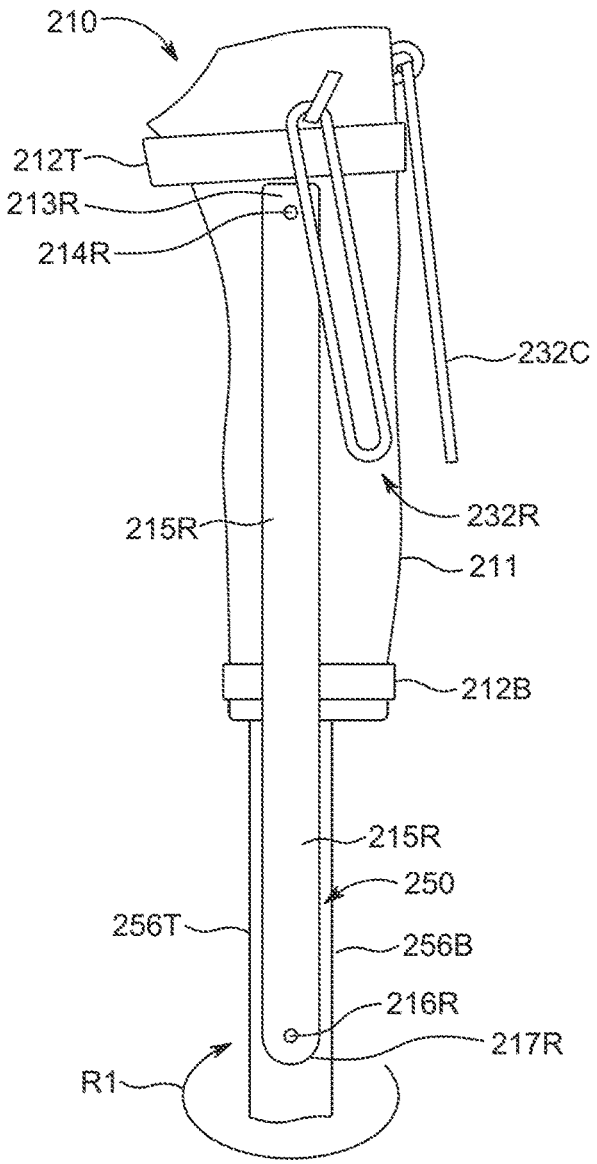
FIG. 10 is a right side elevational view, similar to FIGS. 8 and 9, of the exercise apparatus of FIGS. 8 and 9, but in a fourth stage of use, according to some embodiments.
Figure 11:
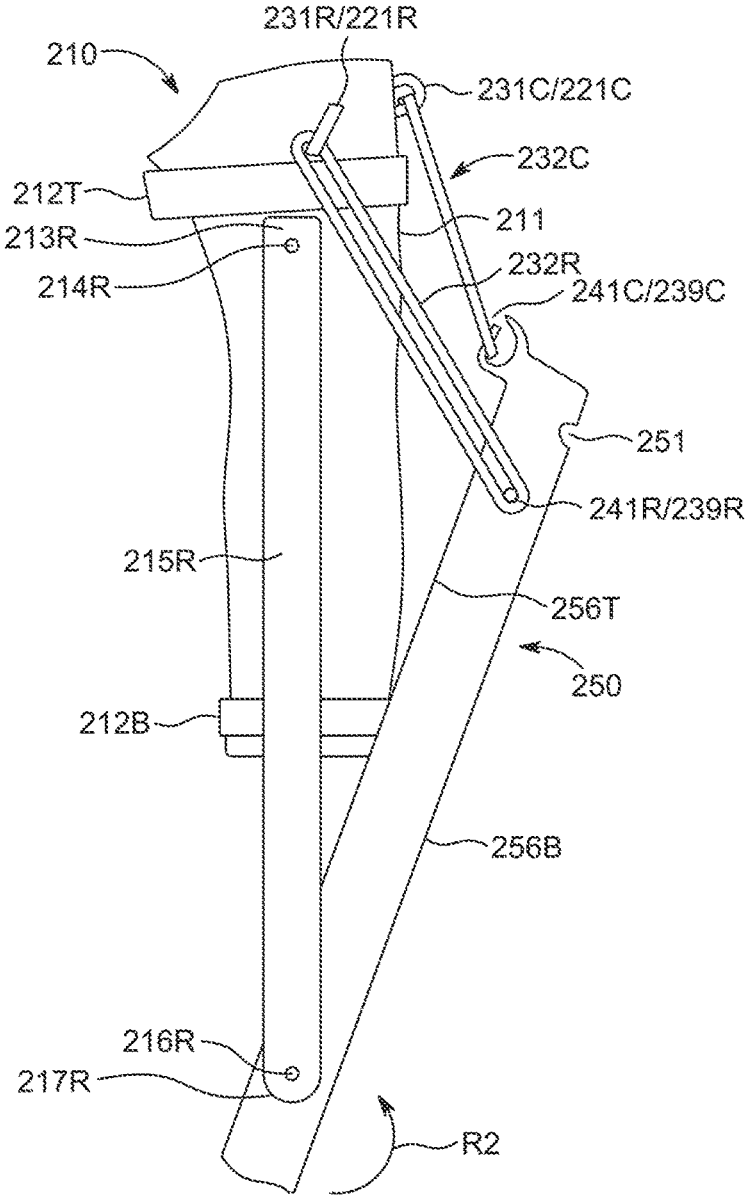
FIG. 11 is a right side elevational view, similar to FIGS. 8-10, of the exercise apparatus of FIGS. 8-10, but in an alternative fourth stage of use, according to some embodiments.

FIGS. 2-11 show an exercise apparatus 200, which may be at least partially similar to apparatus 100, in various stages of use with respect to a user (e.g., a limb 260 of a user of FIGS. 8 and 9). FIG. 2 is a right, top, front perspective view of exercise apparatus 200, in a first stage of use (e.g., a stage of use just prior to apparatus 200 being worn by user limb 260 for exercising), FIG. 3 is a left, top, front perspective view of exercise apparatus 200, in the first stage of use of FIG. 2, FIG. 4 is a top view of exercise apparatus 200, in the first stage of use of FIGS. 2 and 3, FIG. 5 is a top, back perspective view of exercise apparatus 200, in the first stage of use of FIGS. 2-4, FIG. 6 is a top, front perspective view of exercise apparatus 200, in the first stage of use of FIGS. 2-5, FIG. 7 is a bottom view of exercise apparatus 200, in the first stage of use of FIGS. 2-6, FIG. 8 is a right side elevational view of exercise apparatus 200, but with additional features (e.g., components 221C, 232C, and 241C, as described below), in a second stage of use (e.g., one stage of use where user limb 260 may be wearing exercise apparatus 200 for exercising any suitable portion or portions (e.g., any muscle or muscles) of limb 260 through the use of worn exercise apparatus 200), FIG. 9 is a right side elevational view, similar to FIG. 8, of exercise apparatus 200, in a third stage of use (e.g., another stage of use where user limb 260 may be wearing exercise apparatus 200 for exercising any suitable portion or portions (e.g., any muscle or muscles) of limb 260 through the use of worn exercise apparatus 200), FIG. 10 is a right side elevational view, similar to FIGS. 8 and 9, of exercise apparatus 200, in a fourth stage of use (e.g., a stage of use for compact storage of apparatus 200 after apparatus 200 is done being worn by user limb 260 for exercising), and FIG. 11 is a right side elevational view, similar to FIGS. 8-10, of exercise apparatus 200, in an alternative fourth stage of use (e.g., an alternative stage of use for compact storage of apparatus 200 after apparatus 200 is done being worn by user limb 260 for exercising).

FIGS. 2-7 show exercise apparatus 200 in a first stage of use (e.g., a stage of use just prior to apparatus 200 being worn by user limb 260 of FIGS. 8 and 9 for exercising). As shown, apparatus 200 may include an anchor component 210, a base component 250, and a link component 230. Anchor component 210 may be at least partially similar to anchor component 110 of apparatus 100 and may include an anchor body 211 that may be operative to extend along at least a portion of user limb 260 when anchor component 210 is coupled thereto (e.g., along at least a portion of first limb portion 270, as shown in FIGS. 8 and 9). Additionally or alternatively, anchor component 210 may also include at least one limb attachment component, such as upper limb attachment component 212T and a lower limb attachment feature 212B, that may be operative to couple anchor component 210 (e.g., anchor body 211) to user limb 260. For example, as shown in FIGS. 8 and 9, upper limb attachment component 212T may be any suitable mechanism, such as a strap, that may be operative to couple anchor component 210 (e.g., anchor body 211) to user limb 260 (e.g., at location 273 of first limb portion 270), while lower limb attachment component 212B may also be the same type or any other suitable type of mechanism that may be operative to couple anchor component 210 to user limb 260 (e.g., such that components 212T and 212B may interact with different areas of limb portion 270 for a more robust coupling). As shown in FIG. 4, anchor body 211 may include a front anchor body portion 211*f*, to which portions of each limb attachment component may be coupled, and a back anchor body portion 211*b*, which may provide padding for comfort to user limb 260 when anchor component 210 is coupled thereto for being worn by the user.

Base component 250 may be at least partially similar to base component 150 of apparatus 100 and may include a base body 255 with top and bottom base surfaces 256T and 256B as well as left and right base side surfaces 254L and 254R, each of which may generally extend between a back base end 252B and a front base end 252F for forming the structure of base body 255. As shown in FIGS. 7-9 and 11, a groove or channel 251 may be provided in base body 255 through bottom base surface 256B (e.g., across a portion of bottom base surface 256B extending between a portion of left base side surface 254L and right base side surface 254R). Base body 255 may be of any suitable structure for enabling a user to exercise with apparatus 200, as described below in more detail. However, in the embodiments illustrated in FIGS. 2-11, base body 255 may include a structure similar to at least a portion or the entirety of a sole of footwear (e.g., the base of a flip-flop) upon which a user may comfortably position lower limb portion 290 of limb 260 (e.g., a foot of a leg).

In some embodiments, as shown, apparatus 200 may include at least one support component, such as a left support component 218L and a right support component 218R, which may extend between base component 250 and anchor component 210 for preventing anchor component 210 from moving with respect to first limb position 273 when anchor component 210 is coupled to first limb portion 270. For example, as shown, left support component 218L may include a support body 215L that may extend between a top support body end 213L and a bottom support body end 217L, where top support body end 213L may be coupled to any suitable portion of anchor component 210 (e.g., to front anchor body portion 211*f*) via a top support coupling mechanism 214L, and where bottom support body end 217L may be coupled to any suitable portion of base component 250 (e.g., to left base side surface 254L) via a bottom support coupling mechanism 216L. Although the length of support body 215L between top support body end 213L and bottom support body end 217L may be adjustable (e.g., by a user) to any suitable length to dictate the distance between base component 250 and anchor component 210 when apparatus 200 is worn by the user, such a length may be fixed during user exercise with apparatus 200 such that support body 215L may prevent anchor component 210 from sliding up or down along first limb portion 270 (e.g., away from first limb position 273). Alternatively or additionally, as shown, right support component 218R may include a support body 215R that may extend between a top support body end 213R and a bottom support body end 217R, where top support body end 213R may be coupled to any suitable portion of anchor component 210 (e.g., to front anchor body portion 2110 via a top support coupling mechanism 214R, and where bottom support body end 217R may be coupled to any suitable portion of base component 250 (e.g., to right base side surface 254R) via a bottom support coupling mechanism 216R. Although the length of support body 215R between top support body end 213R and bottom support body end 217R may be adjustable (e.g., by a user) to any suitable length to dictate the distance between base component 250 and anchor component 210 when apparatus 200 is worn by the user, such a length may be fixed during user exercise with apparatus 200 such that support body 215R may prevent anchor component 210 from sliding up or down along first limb portion 270 (e.g., away from first limb position 273). As shown, apparatus 200 may include two support components, such as left support component 218L and right support component 218R, that may be positioned on opposite sides of limb 260 when apparatus 200 is worn by the user, thereby providing suitable support on opposite sides of anchor component 210. Alternatively, any other suitable number of support components may be provided, such as a single support component that may extend between base component 250 (e.g., at back base end 252B) and anchor component 210 (e.g., at a limb attachment component).

Each one of support coupling mechanisms 214L, 214R, 216L, and 216R may be any suitable coupling mechanism, such as a coupling mechanism that fixes the orientation of a support body with respect to anchor component 210 and/or base component 250, or a coupling mechanism that enables rotation of the support body with respect to anchor component 210 and/or base component 250. For example, each one of support coupling mechanisms 214L and 214R may enable anchor component 210 to rotate about such support coupling mechanisms for enabling more comfortable use of apparatus 200 by a user during exercise (e.g., mechanism 214L may rotatably couple anchor component 210 to left support component 218L and mechanism 214R may rotatably couple anchor component 210 to right support component 218R). Additionally or alternatively, for example, as shown in FIG. 10, each one of support coupling mechanisms 216L and 216R may enable base component 250 to rotate about such support coupling mechanisms in the direction of arrow RI from the first stage of use of FIGS. 2-7 to the fourth stage of use of FIG. 10 (e.g., mechanism 216L may rotatably couple base component 250 to left support component 218L and mechanism 216R may rotatably couple base component 250 to right support component 218R), whereby base component 250 may be proximate, adjacent, or even contacting anchor component 210 (e.g., front base end 252F may be operative to contact portion 211E of support body 211 of anchor component 210), whereby such a fourth stage may enable the overall space occupied by apparatus 200 to be reduced (e.g., for easy storage when not being worn by the user). In some embodiments, a limb attachment component (e.g., limb attachment component 212T and/or limb attachment component 212B) may be operative to retain base component 250 at such an orientation of FIG. 10 (e.g., similarly to how such attachment components may be operative to retain a cross-section of a user's limb). Additionally or alternatively, as another example, as shown in FIG. 11, each one of support coupling mechanisms 216L and 216R may enable base component 250 to rotate about such support coupling mechanisms in the direction of arrow R2 from the first stage of use of FIGS. 2-7 to the fourth stage of use of FIG. 11, whereby base component 250 may be proximate, adjacent, or even contacting anchor component 210 (e.g., top base surface 256T may be operative to contact portion 211F of support body 211 of anchor component 210), whereby such a fourth stage may enable the overall space occupied by apparatus 200 to be reduced (e.g., for easy storage when not being worn by the user). In some embodiments, a limb attachment component (e.g., a link body, such as link body 232R, 232L, and/or 232C, as described below in more detail, may be operative to retain base component 250 at such an orientation of FIG. 11.

Link component 230 of apparatus 200 may be at least partially similar to link component 130 of apparatus 100 and may include at least one link body (e.g., left link body 232L, right link body 232R, and/or center link body 232C) extending between a first link portion (e.g., first left link portion 231L, first right link portion 231R, and/or first center link portion 231C, respectively) and a second link portion (e.g., second left link portion 239L, second right link portion 239R, and/or second center link portion 239C, respectively). At least a portion of each link body may include an elastic portion, for example, similar to elastic portion 134 of apparatus 100. As shown, one, some, or each first link portion (e.g., first left link portion 231L, first right link portion 231R, and/or first center link portion 231C) may be coupled to first limb portion 270 of user limb 260 at or about first limb position 273 via anchor component 210 when anchor component 210 is coupled to first limb portion 270 at or about first limb position 273, where, for example, a first link portion may be coupled to anchor component 210 via any suitable link anchor retention mechanism(s) of anchor component 210 (e.g., left link anchor retention mechanism 221L, right link anchor retention mechanism 221R, and/or center link anchor retention mechanism 221C). For example, as shown in FIGS. 2-11, each link body 232 of link component 230 may be a closed loop (e.g., an at least partially elastic or deformable loop, such as a rubber band or other suitable material(s)), and each link anchor retention mechanism of anchor component 210 (e.g., link anchor retention mechanisms 221L/221R/221C) may be a closed ring (e.g., a metal or plastic or otherwise structurally rigid ring) through which a respective first link portion of a respective link body may be passed (e.g., by a manufacturer) for securing (e.g., unremovably or fixedly coupling) each link body of link component 230 to anchor component 210. In other embodiments, as described below with respect to FIGS. 12-17, one or more link bodies may not be a closed loop and/or one or more anchor retention mechanisms may not be a closed ring such that a link body may or may not be removably coupled to an anchor component. Additionally or alternatively, in some embodiments, one, some, or each second link portion (e.g., second left link portion 239L, second right link portion 239R, and/or second center link portion 239C, respectively) may be coupled to second limb portion 290 at or about second limb position 293 via base component 250 when base component 250 is coupled to second limb portion 290 at or about second limb position 293, where, for example, a second link portion may be coupled to base component 250 via any suitable link base retention mechanism(s) of base component 250 (e.g., left link base retention mechanism 241L, right link base retention mechanism 241R, and/or center link base retention mechanism 241C). For example, as shown in FIGS. 2-11, each link body 232 of link component 230 may be a closed loop, and each link base retention mechanism of base component 250 (e.g., link base retention mechanisms 241L/241R/241C) may be a hook with a free end (e.g., a metal or plastic or otherwise structurally rigid feature with an open end) about which a respective second link portion of a respective link body may be looped (e.g., by a user) for coupling (e.g., removably or temporarily coupling) each link body of link component 230 to base component 250. Alternatively, in some embodiments (e.g., as described in more detail below with respect to apparatus 300 of FIG. 12), second link portion 239C of link body 232C may be looped about base body 255 and coupled to bottom base surface 256B (e.g., within groove 251). In other embodiments, as described below with respect to FIGS. 12-17, one or more link bodies may not be a closed loop and/or one or more base retention mechanisms may not be a hook such that a link body may or may not be removably coupled to a base component. Although FIGS. 2-7 may show multiple (e.g., three) distinct closed loops provided by each of left link body 232L and right link body 232R, such that none, one, some, or all of the distinct loops may be removably coupled to base component 250 for varying the resistance that may be provided by apparatus 200 to user limb 260 during exercise, FIGS. 8-11 may only show one such loop provided by each of left link body 232L and right link body 232R for the sake of clarity.

As shown in FIGS. 8 and 9, user limb 260 may be similar to user limb 160 and may include a first limb portion 270 having a first limb body 272 that may extend between a distal end 271 and a joint end 279, a second limb portion 290 having a second limb body 292 that may extend between a distal end 291 and a joint end 299, and a joint limb portion 280 that may be positioned between first limb portion 270 and second limb portion 290 (e.g., between joint ends 279 and 299) and/or that may couple first limb portion 270 to second limb portion 290. Limb 260 may be any suitable limb of a user, such as a leg of a user, as shown, whereby joint limb portion 280 may be the ankle joint of the leg, while first limb portion 270 may be the cnemis of the leg, and while second limb portion 290 may be the foot of the leg. At some point, a user may couple anchor component 210 to first limb portion 270 at first limb position 273 (e.g., by using one or both of limb attachment components 212T and 212B and/or one or both support components 218L and 218R) and, before or during or after such anchor-limb coupling, the user may position second limb portion 290 against base component 250 (e.g., by engaging at least a portion of top base surface 256T with at least a portion of the bottom of the user's foot or limb portion 290). As shown in FIG. 8, for example, such anchor-limb coupling and such base-limb coupling may together result in user's limb 260 properly wearing apparatus 200 for use in exercising. Prior to, during, or after such anchor-limb coupling and such base-limb coupling, one or more link bodies of link component 230 may be coupled to both anchor component 210 at or about position 273 and base component 250 at or about position 293. For example, as shown in FIGS. 8 and 9, first right link portion 231R of right link body 232R may be coupled to anchor component 210 via right link anchor retention mechanism 221R and second right link portion 239R of right link body 232R may be coupled to base component 250 via right link base retention mechanism 241R, and first center link portion 2310 of center link body 232C may be coupled to anchor component 210 via center link anchor retention mechanism 221C and second center link portion 239C of center link body 232C may be coupled to base component 250 via center link base retention mechanism 241C. Although not shown in FIGS. 8 and 9, first left link portion 231L of left link body 232L may be coupled to anchor component 210 via left link anchor retention mechanism 221L and second left link portion 239L of left link body 232L may be coupled to base component 250 via left link base retention mechanism 241L when more resistance is desired for the exercise, otherwise at least one link portion of left link body 232L may not be coupled to anchor component 210 and/or base component 250 when less resistance is desired for the exercise.

The elasticity (e.g., elastic modulus) of each link body of link component 230 may be operative to provide at least some resistance to user limb 260 when that link body is coupled to both anchor component 210 and base component 250 and when user limb 260 is at the second stage of use of apparatus 200 of FIG. 8 (e.g., at a stage when anchor component 210 is coupled to limb portion 270, when base component 250 is coupled to (e.g., interfacing with) limb portion 290, and when limb 260 is exerting a suitable force on apparatus 200 to maintain or increase the distance between two portions of that link body extending between anchor component 210 and base component 250). For example, as shown in FIG. 8, limb 260 may be wearing apparatus 200 and may be exercising by exerting a force on apparatus 200 (e.g., using joint limb portion 280) for at least maintaining or increasing the distance between first center link portion 231C of center link body 232C and second center link portion 239C of center link body 232C (e.g., the distance between center link anchor retention mechanism 221C and center link base retention mechanism 241C) such that the elasticity of center link body 232C may be operative to provide a resistance to limb 260 (e.g., as described above with respect to arrows F and N of FIG. 1). Additionally or alternatively, as shown in FIG. 8, limb 260 may be wearing apparatus 200 and may be exercising by exerting a force on apparatus 200 (e.g., using joint limb portion 280) for at least maintaining or increasing the distance between first right link portion 231R of right link body 232R and second right link portion 239R of right link body 232R (e.g., the distance between right link anchor retention mechanism 221R and right link base retention mechanism 241R) such that the elasticity of right link body 232R may be operative to provide a resistance to limb 260 (e.g., as described above with respect to arrows F and N of FIG. 1). Each body portion of link component 230 may have a different elasticity or the same elasticity for providing the different or same resistance to an exercising limb. In some embodiments, as shown in FIG. 8, such a second stage of use of apparatus 200 may be enabled when user limb 260 holds at least a portion or all of bottom base surface 256B against a stable or stationary surface S (e.g., the ground), which may enable apparatus 200 to be used while the user is standing or sitting with its foot on the ground.

A third stage of use of apparatus 200 may be shown in FIG. 9, whereby, after the second stage of use of FIG. 8, user limb 260 may continue to exercise by reducing a force exerted on apparatus 200 (e.g., using joint limb portion 280). For example, such a reduction in user limb force may decrease the distance between first center link portion 231C of center link body 232C and second center link portion 239C of center link body 232C (e.g., the distance between center link anchor retention mechanism 221C and center link base retention mechanism 241C), whereby the elasticity of center link body 232C may be operative to at least partially decrease that distance due to the reduction in user limb force (e.g., as described above with respect to arrows E and O of FIG. 1), whereby link body 232C may at least partially underform from its deformed or stressed length CL2 of the second stage of FIG. 8 to a less deformed or less stressed (e.g., shorter) length CL3 of the third stage of FIG. 9, which may or may not be the original or relaxed length of link body 232C. Additionally or alternatively, such a reduction in user limb force may decrease the distance between first right link portion 231R of right link body 232R and second right link portion 239R of right link body 232R (e.g., the distance between right link anchor retention mechanism 221R and right link base retention mechanism 241R), whereby the elasticity of right link body 232R may be operative to at least partially decrease that distance due to the reduction in user limb force (e.g., as described above with respect to arrows E and O of FIG. 1), whereby link body 232R may at least partially underform from its deformed or stressed length of the second stage of FIG. 8 to a less deformed or less stressed (e.g., shorter) length of the third stage of FIG. 9, which may or may not be the original or relaxed length of link body 232R.

After reaching such a third stage of use (e.g., of FIG. 9), limb 260 may continue to exercise by exerting a suitable force on apparatus 200 to return to the second stage of use (e.g., of FIG. 8), whereby each repetition of moving apparatus 200 between its second and third stages of use may further strengthen one or more portions (e.g., muscles) of limb 260. In some embodiments, as shown in FIG. 9, such a third stage of use of apparatus 200 may be enabled when user limb 260 holds a portion of bottom base surface 256B (e.g., proximate end 299) and/or a portion of second limb portion 290 itself (e.g., end 299) against a stable or stationary surface S (e.g., the ground), which may enable apparatus 200 to be moved between its second and third stages of use while the user is standing or sitting with at least a portion of its foot (e.g., a heel of the foot at end 299) always on the ground (e.g., directly or via base component 250). In such embodiments, a distance D created between surface S and base component 250 and/or second limb portion 290 (e.g., at or near position 293, such as a ball of a user's foot) at the third stage of use may be any suitable distance, which may vary based on the resistance provided by link component 230 and/or based on the amount of exercise desired by the user. In other embodiments, surface S may be an imaginary surface in space or may not be considered at all, whereby second limb portion 290 may be held and moved within open space when apparatus 200 is moved between its second and third stages during exercise of limb 260. It is to be understood that, in some embodiments, each one of support coupling mechanisms 216L and 216R may enable base component 250 to rotate about such support coupling mechanisms in the direction of arrow R3 from the second stage of use of FIG. 8 to the third stage of use of FIG. 9 and/or in the direction of arrow R4 from the third stage of use of FIG. 9 to the second stage of use of FIG. 8. Alternatively or additionally, at least a portion of base component 250 may be flexible for enabling at least a portion of such movement of base component 250 (e.g., at least proximate mechanism(s) 241R and/or 241C) such that apparatus 200 may be moved between its second and third stages. Although a transition between the third stage of use of FIG. 9 and the second stage of use of FIG. 8 has been described to include user limb 260 exerting a force on apparatus 200 for maintaining or increasing the distance between a link anchor retention mechanism and a link base retention mechanism associated with a particular link body of link component 230 (e.g., against a resistance of that link body) and although a transition between the second stage of use of FIG. 8 and the third stage of use of FIG. 9 has been described to include user limb 260 reducing the magnitude of such a force exerted on apparatus 200 for decreasing the distance between the link anchor retention mechanism and the link base retention mechanism associated with that particular link body of link component 230 (e.g., leveraging a resistance of that link body), where such a particular link body may include an elastic portion that provides resistance when its length is stretched (e.g., increased from CL3 to CL2) from its original or relaxed length to a deformed or stressed length (e.g., a rubber band), it is to be understood that in other embodiments, a transition between the second stage of use of FIG. 8 and the third stage of use of FIG. 9 may include a user limb 260 exerting a force on apparatus 200 for maintaining or decreasing the distance between a link anchor retention mechanism and a link base retention mechanism associated with a particular link body of link component 230 (e.g., against a resistance of that link body) and a transition between the third stage of use of FIG. 9 and the second stage of use of FIG. 8 may include user limb 260 reducing the magnitude of such a force exerted on apparatus 200 for increasing the distance between the link anchor retention mechanism and the link base retention mechanism associated with that particular link body of link component 230 (e.g., leveraging a resistance of that link body), where such a particular link body may include an elastic portion that provides resistance when its length is compressed (e.g., decreased from CL2 to CL3) from its original or relaxed length to a deformed or stressed length (e.g., a compression spring).

Figure 12:
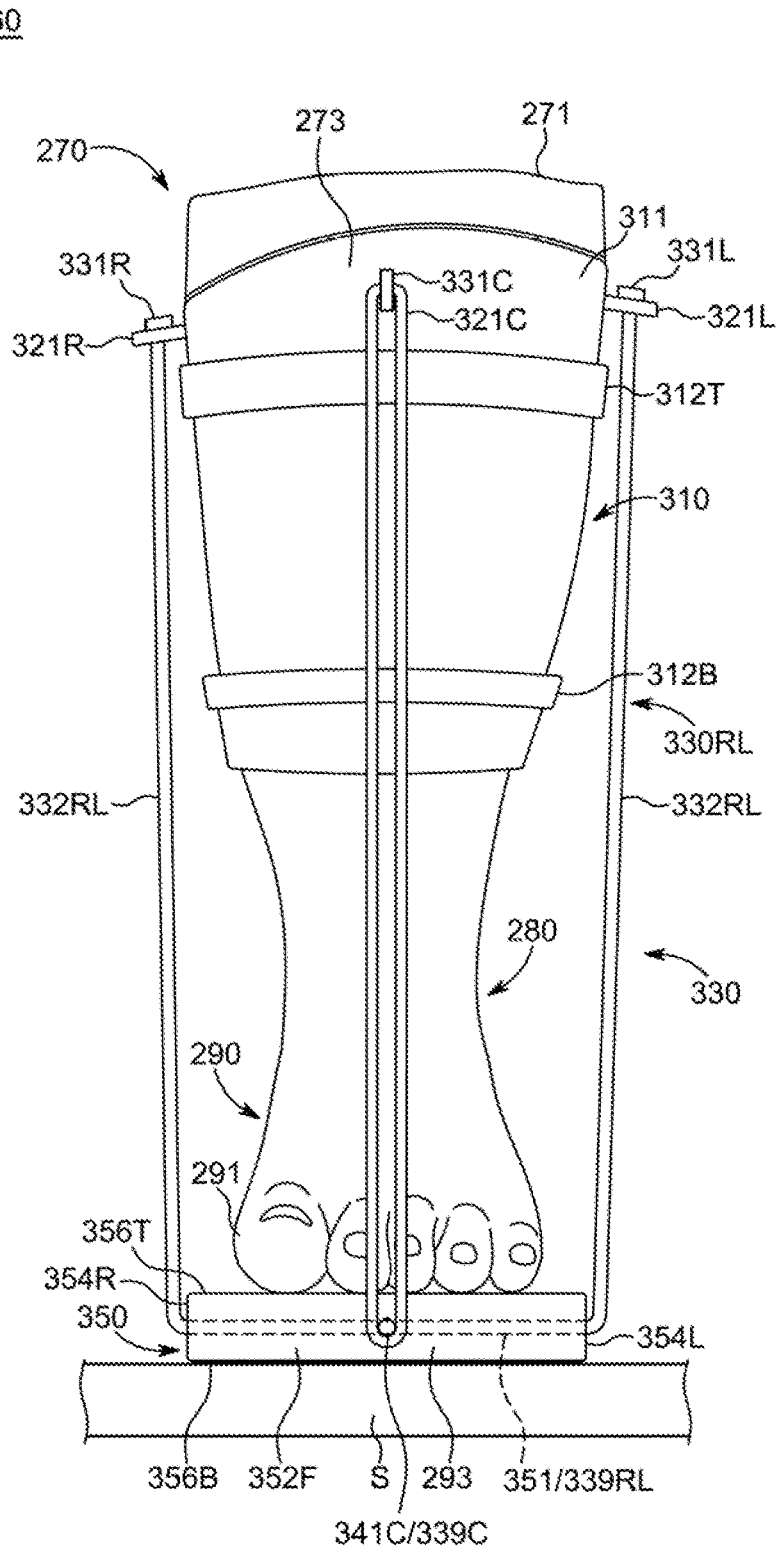
FIG. 12 is a front elevational view of another exercise apparatus, in a second stage of use, similar to the stage of use of FIG. 8, according to some embodiments.

FIG. 12 shows a front elevational view of another exercise apparatus 300 worn by user limb 260, in a second stage of use, similar to the stage of use of FIG. 8. Apparatus 300 of FIG. 12 may be similar to apparatus 200 of FIGS. 2-11 but may not include any support components but may include a link body looped underneath a portion of a base body. Apparatus 300 of FIG. 12 may include similar components to apparatus 200 of FIGS. 2-11, with components of apparatus 300 of FIG. 12 being labeled with "3xx" reference labels that may correspond to the "2xx" reference labels of the labeled components of apparatus 200 of FIGS. 2-11, where differences therebetween may be described below.

As shown, apparatus 300 may include an anchor component 310, a base component 350, and a link component 330. Anchor component 310 may include an anchor body 311 that may be operative to extend along at least a portion of user limb 260 when anchor component 310 is coupled thereto (e.g., along at least a portion of first limb portion 270). Additionally or alternatively, anchor component 310 may also include at least one limb attachment component, such as upper limb attachment component 312T and a lower limb attachment feature 312B, that may be operative to couple anchor component 310 (e.g., anchor body 311) to user limb 260 (e.g., at location 273 of first limb portion 270).

Base component 350 may include a base body 355 with top and bottom base surfaces 356T and 256B as well as left and right base side surfaces 354L and 354R, each of which may generally extend between a back base end and a front base end 352F for forming the structure of base body 355. A groove or channel 351 may be provided in base body 355 through bottom base surface 356B (e.g., across a portion of bottom base surface 356B extending between a portion of left base side surface 354L and right base side surface 354R). Base body 355 may be of any suitable structure for enabling a user to exercise with apparatus 300, as described below in more detail. However, in the embodiment illustrated in FIG. 12, base body 355 may include a structure similar to at least a portion or the entirety of a sole of footwear (e.g., the base of a flip-flop) upon which a user may comfortably position lower limb portion 290 of limb 260 (e.g., a foot of a leg). Although not shown in FIG. 12, apparatus 300 may or may not include at least one support component, which may extend between base component 350 and anchor component 310 for preventing anchor component 310 from moving with respect to first limb position 273 when anchor component 310 is coupled to first limb portion 270 (e.g., similar to left support component 218L and right support component 218R of apparatus 200).

Link component 330 of apparatus 300 may include at least one link body (e.g., right-left link body 332RL and/or center link body 332C) extending between a first link portion (e.g., first right-left link portion 331R and/or first center link portion 331C, respectively) and a second link portion (e.g., second right-left link portion 331L and/or second center link portion 339C, respectively). At least a portion of each link body may include an elastic portion, for example, similar to elastic portion 134 of apparatus 100. As shown, one, some, or each link portion (e.g., first right-left link portion 331R, first right-left link portion 331L, and/or first center link portion 331C) may be coupled to first limb portion 270 of user limb 260 at or about first limb position 273 via anchor component 310 when anchor component 310 is coupled to first limb portion 270 at or about first limb position 273, where, for example, a link portion may be coupled to anchor component 310 via any suitable link anchor retention mechanism(s) of anchor component 310 (e.g., left link anchor retention mechanism 321L, right link anchor retention mechanism 321R, and/or center link anchor retention mechanism 321C). For example, as shown in FIG. 12, link body 332C may be a closed loop (e.g., an at least partially elastic or deformable loop, such as a rubber band or other suitable material(s)), and associated link anchor retention mechanism 321C may be a closed ring (e.g., a metal or plastic or otherwise structurally rigid ring) through which first center link portion 331C of link body 332C may be passed (e.g., by a manufacturer) for securing (e.g., unremovably or fixedly coupling) link body 332C of link component 330 to anchor component 310. As another example, as shown in FIG. 12, link body 332RL may not be a closed loop but may instead be a segment (e.g., an at least partially elastic or deformable segment, such as a non-looped rubber band or other suitable material(s)) extending between free end link portions 331R and 331L, and associated link anchor retention mechanisms 321R and 321L may be closed rings with a hollow having a cross-sectional area less than that of respective ends 331R/331L and through which link body 332RL may be passed (e.g., by a manufacturer) for securing (e.g., unremovably or fixedly coupling) link body 332RL of link component 330 to anchor component 310. Additionally or alternatively, in some embodiments, another portion of one, some, or each link body (e.g., second right-left link portion 339RL and/or second center link portion 339C, respectively) may be coupled to second limb portion 290 at or about second limb position 293 via base component 350 when base component 350 is coupled to second limb portion 290 at or about second limb position 293, where, for example, a second link portion may be coupled to base component 350 via any suitable link base retention mechanism(s) of base component 350. For example, as shown in FIG. 12, center link body 332C of link component 330 may be a closed loop, and a link base retention mechanism 341C of base component 350 may be a hook with a free end (e.g., a metal or plastic or otherwise structurally rigid feature with an open end) about which a respective second center link portion 339C of link body 332C may be looped (e.g., by a user) for coupling (e.g., removably or temporarily coupling) link body 332C of link component 330 to base component 350. As another example, as shown in FIG. 12, right-left link body 332RL of link component 330 may be a segment, and a link base retention mechanism may be provided by channel 351 about which second right-left link portion 339RL of link body 332RL (e.g., between ends 331R and 331L) may be looped (e.g., by a user) for coupling (e.g., removably or temporarily coupling) link body 332RL of link component 330 to base component 350. Such apparatus 300 of FIG. 12 may otherwise be used similarly to apparatus 200 of FIGS. 2-11.

Figure 13:
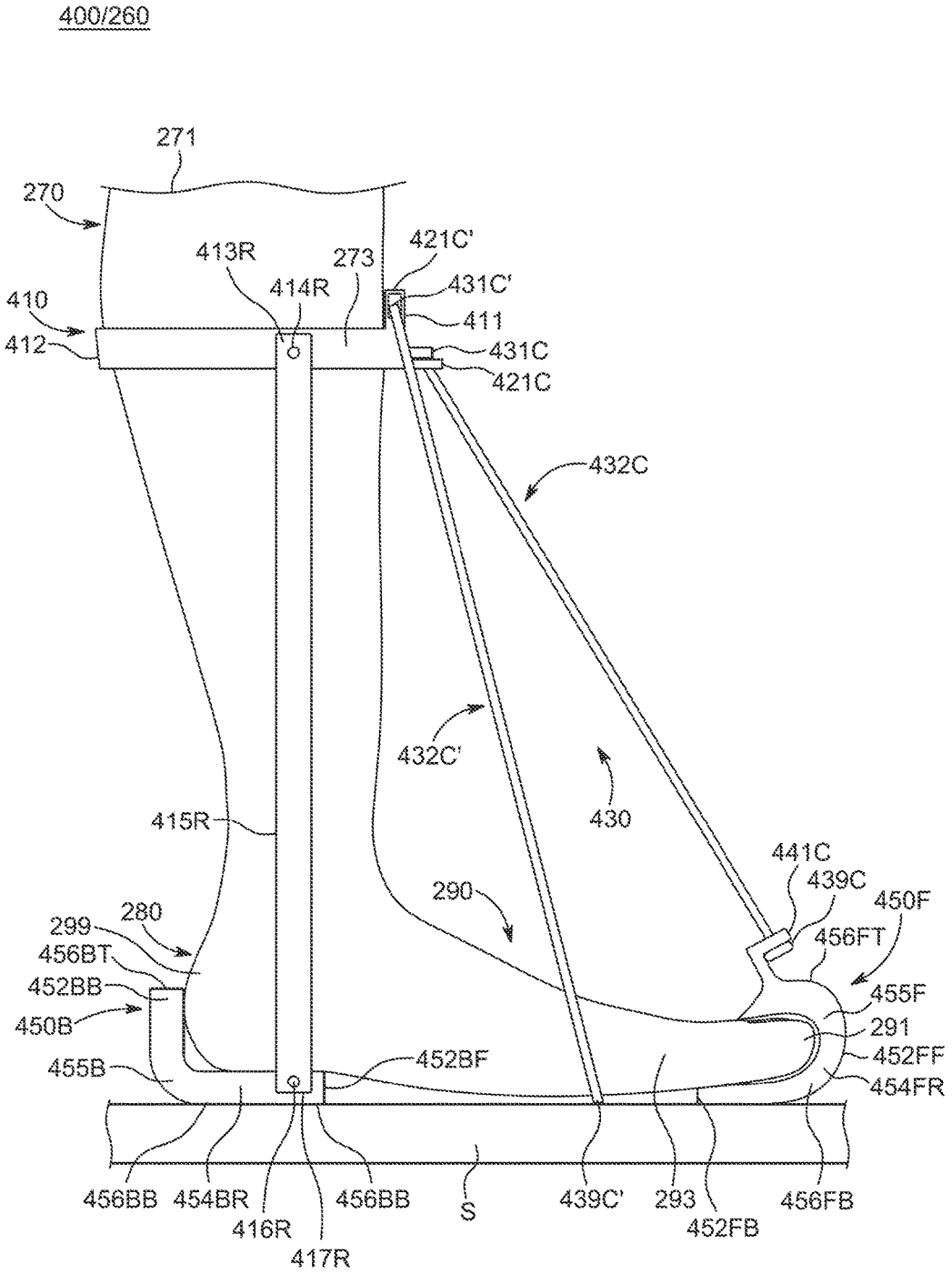
FIG. 13 is a right side elevational view, similar to FIGS. 8-11, of yet another exercise apparatus, in a second stage of use, similar to the stage of use of FIGS. 8 and 12, according to some embodiments.
Figure 14:
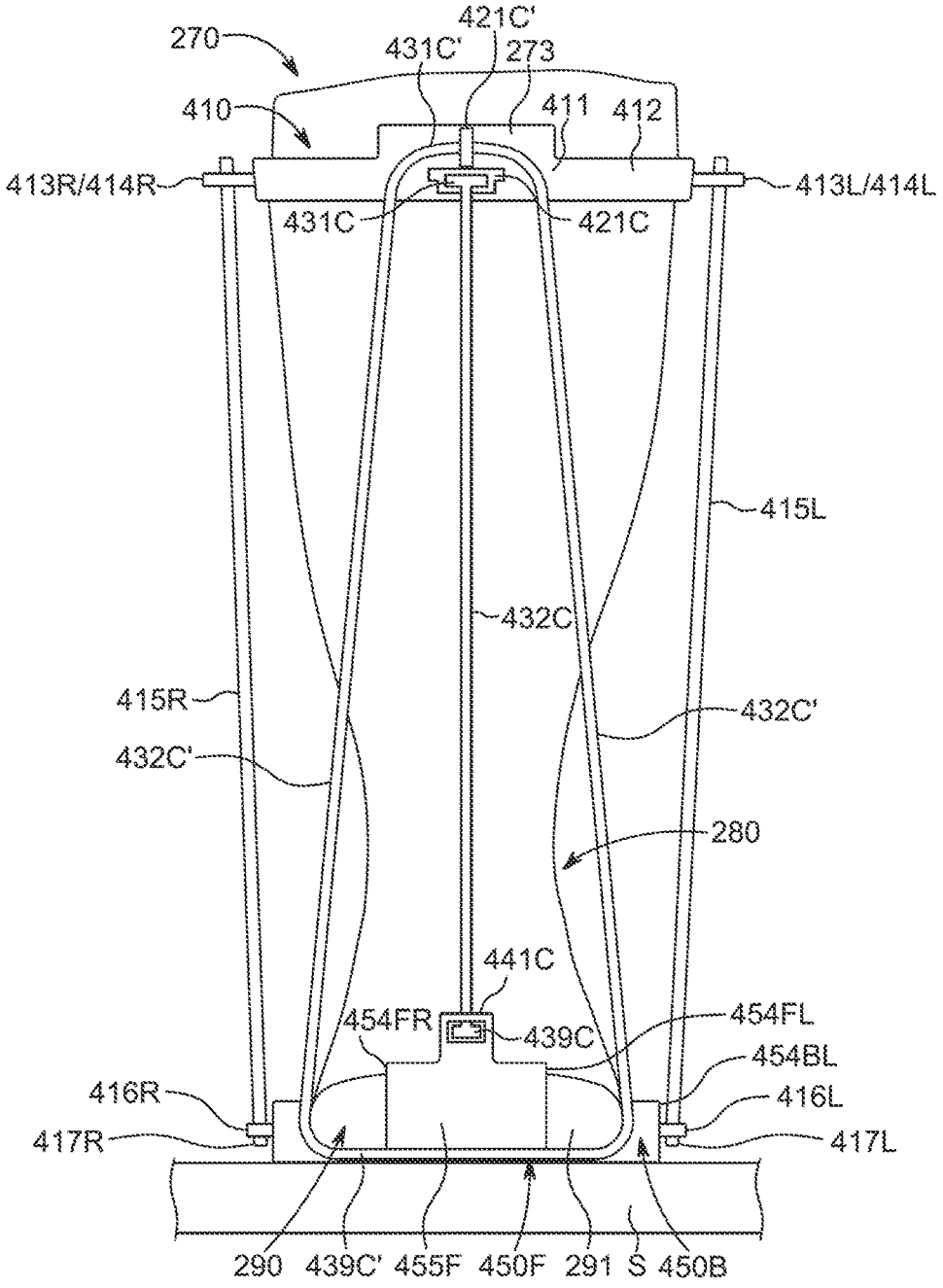
FIG. 14 is a front elevational view, similar to FIG. 12, of the exercise apparatus of FIG. 13, in the second stage of use of FIG. 13, according to some embodiments.

FIG. 13 shows a right side elevational view, similar to FIGS. 8-11, of yet another exercise apparatus 400, in a second stage of use, similar to the stage of use of FIGS. 8 and 12, while FIG. 14 shows a front elevational view, similar to FIG. 12, of exercise apparatus 400, in the second stage of use of FIG. 13. Apparatus 400 of FIGS. 13 and 14 may be similar to apparatus 200 of FIGS. 2-11 but may include two distinct base bodies, a single limb attachment component, at least one link body removably coupled to an anchor body but fixedly coupled to a base body, and a link body removably coupled to a user limb. Apparatus 400 of FIGS. 13 and 14 may include similar components to apparatus 200 of FIGS. 2-11, with components of apparatus 400 of FIGS. 13 and 14 being labeled with "4xx" reference labels that may correspond to the "2xx" reference labels of the labeled components of apparatus 200 of FIGS. 2-11, where differences therebetween may be described below.

As shown, apparatus 400 may include an anchor component 410, a back base component 450B and a front base component 450F, and a link component 430. Anchor component 410 may include an anchor body 411 that may be operative to extend along at least a portion of user limb 260 when anchor component 410 is coupled thereto (e.g., at location 273 along at least a portion of first limb portion 270). Additionally or alternatively, anchor component 410 may also a limb attachment component 412 that may be operative to couple anchor component 410 (e.g., anchor body 411) to user limb 260 (e.g., at location 273 of first limb portion 270). Limb attachment component 412 may be any suitable mechanism, such as a strap, and may provide the geometry for most if not all of anchor body 411.

A front base component 450F may include a front base body 455F with top and bottom front base surfaces 456FT and 456FB as well as left and right front base side surfaces 454FL and 454FR, each of which may generally extend between a back front base end 452FB and a front front base end 452FF for forming the structure of front base body 455F. As shown, front base body 455F may be operative to surround, support, or otherwise contact at least a portion second limb portion 290 (e.g., at limb end 291, such as about a toe region from underneath the foot and about a front of the foot and/or over a portion of the top of the foot). A back base component 450B may include a back base body 455B with top and bottom back base surfaces 456BT and 456BB as well as a left back base side surface 454BL and right back base side surface 454BR, each of which may generally extend between a back back base end 452BB and a front back base end 452BF for forming the structure of back base body 455B. As shown, back base body 455B may be operative to surround, support, or otherwise contact at least a portion second limb portion 290 (e.g., at limb end 299, such as about a heel region from underneath the foot and/or about a back of the foot).

Apparatus 400 may include at least one support component, such as a left support component 418L and a right support component 418R, which may extend between back base component 450B and anchor component 410 for preventing anchor component 410 from moving with respect to first limb position 273 when anchor component 410 is coupled to first limb portion 270. For example, as shown, left support component 418L may include a support body 415L that may extend between a top support body end 413L and a bottom support body end 417L, where top support body end 413L may be coupled to any suitable portion of anchor component 410 via a top support coupling mechanism 414L, and where bottom support body end 417L may be coupled to any suitable portion of base component 450B (e.g., to surface 454BL) via a bottom support coupling mechanism 416L. Alternatively or additionally, as shown, right support component 418R may include a support body 415R that may extend between a top support body end 413R and a bottom support body end 417R, where top support body end 413R may be coupled to any suitable portion of anchor component 410 via a top support coupling mechanism 414R, and where bottom support body end 417R may be coupled to any suitable portion of base component 450B (e.g., to surface 454BR) via a bottom support coupling mechanism 416R. As shown, apparatus 400 may include two support components, such as left support component 418L and right support component 418R, that may be positioned on opposite sides of limb 260 when apparatus 400 is worn by the user, thereby providing suitable support on opposite sides of anchor component 410. Alternatively, any other suitable number of support components may be provided, such as a single support component that may extend between base component 450B (e.g., at back base end 452BB) and anchor component 410 (e.g., at limb attachment component 412), or no support components may be provided by apparatus 400.

Link component 430 of apparatus 400 may include at least one link body (e.g., first center link body 432C and/or second center link body 432C) extending between a first link portion (e.g., first first center link portion 4310 and/or first second center link portion 431C', respectively) and a second link portion (e.g., second first center link portion 439C and/or second second center link portion 439C', respectively). At least a portion of each link body may include an elastic portion, for example, similar to elastic portion 134 of apparatus 100. As shown, one, some, or each first link portion (e.g., first first center link portion 431C and/or first second center link portion 431C') may be coupled to first limb portion 270 of user limb 260 at or about first limb position 273 via anchor component 410 when anchor component 410 is coupled to first limb portion 270 at or about first limb position 273, where, for example, a link portion may be coupled to anchor component 410 via any suitable link anchor retention mechanism(s) of anchor component 410 (e.g., first center link anchor retention mechanism 421C and/or second center link anchor retention mechanism 421C). For example, as shown in FIGS. 13 and 14, link body 432C' may be a closed loop (e.g., an at least partially elastic or deformable loop, such as a rubber band or other suitable material(s)), and associated link anchor retention mechanism 421C may be a closed ring (e.g., a metal or plastic or otherwise structurally rigid ring) through which first center link portion 431C of link body 432C may be passed (e.g., by a manufacturer) for securing (e.g., unremovably or fixedly coupling) link body 432C of link component 430 to anchor component 410. As another example, as shown in FIGS. 13 and 14, link body 432C may not be a closed loop but may instead be a segment (e.g., an at least partially elastic or deformable segment, such as a non-looped rubber band or other suitable material(s)) extending between free end link portions 431C and 439C, and an associated link anchor retention mechanism 421C may be an open ring (e.g., C-shaped) with a hollow having a cross-sectional area less than that of respective end 431C, whereby an opening in the ring may enable receipt of a portion of link body 432C after which tension of body 432C and the larger cross-sectional area of end 431C may thereby enable link body 432C to be removably coupled to link anchor retention mechanism 421C (e.g., by a user). Additionally or alternatively, in some embodiments, another portion of one, some, or each link body (e.g., second first center link portion 439C and/or second second center link portion 439C', respectively) may be coupled to second limb portion 290 at or about second limb position 293 via front base component 450F when front base component 450F is coupled to second limb portion 290 at or about second limb position 293, where, for example, a second link portion may be coupled to base component 450F via any suitable link base retention mechanism(s) of base component 450F. For example, as shown in FIGS. 13 and 14, center link body 432C of link component 430 may not be a closed loop but may instead be a segment (e.g., an at least partially elastic or deformable segment, such as a non-looped rubber band or other suitable material(s)) extending between free end link portions 431C and 439C, and associated link base retention mechanism 441C may include a feature with a hollow having a cross-sectional area less than that of respective end 439C and through which link body 432C may be passed (e.g., by a manufacturer) for securing (e.g., unremovably or fixedly coupling) link body 432C of link component 430 to base component 450F. As another example, as shown in FIGS. 13 and 14, link body 432C' of link component 430 may be a closed loop (e.g., an at least partially elastic or deformable loop, such as a rubber band or other suitable material(s)), and a link retention mechanism may be provided directly by a portion of second limb portion 290 (e.g., at or near position 293, such as the bottom of a user's foot near the ball of the foot, similarly to channel 351 of base component 350 of apparatus 300) about which portion 439C of link body 432C' may be looped (e.g., by a user) for coupling (e.g., removably or temporarily coupling) link body 432C of link component 430 to user limb 460 when apparatus 400 is worn by limb 460. Such apparatus 400 of FIGS. 13 and 14 may otherwise be used similarly to apparatus 200 of FIGS. 2-11.

Figure 15:
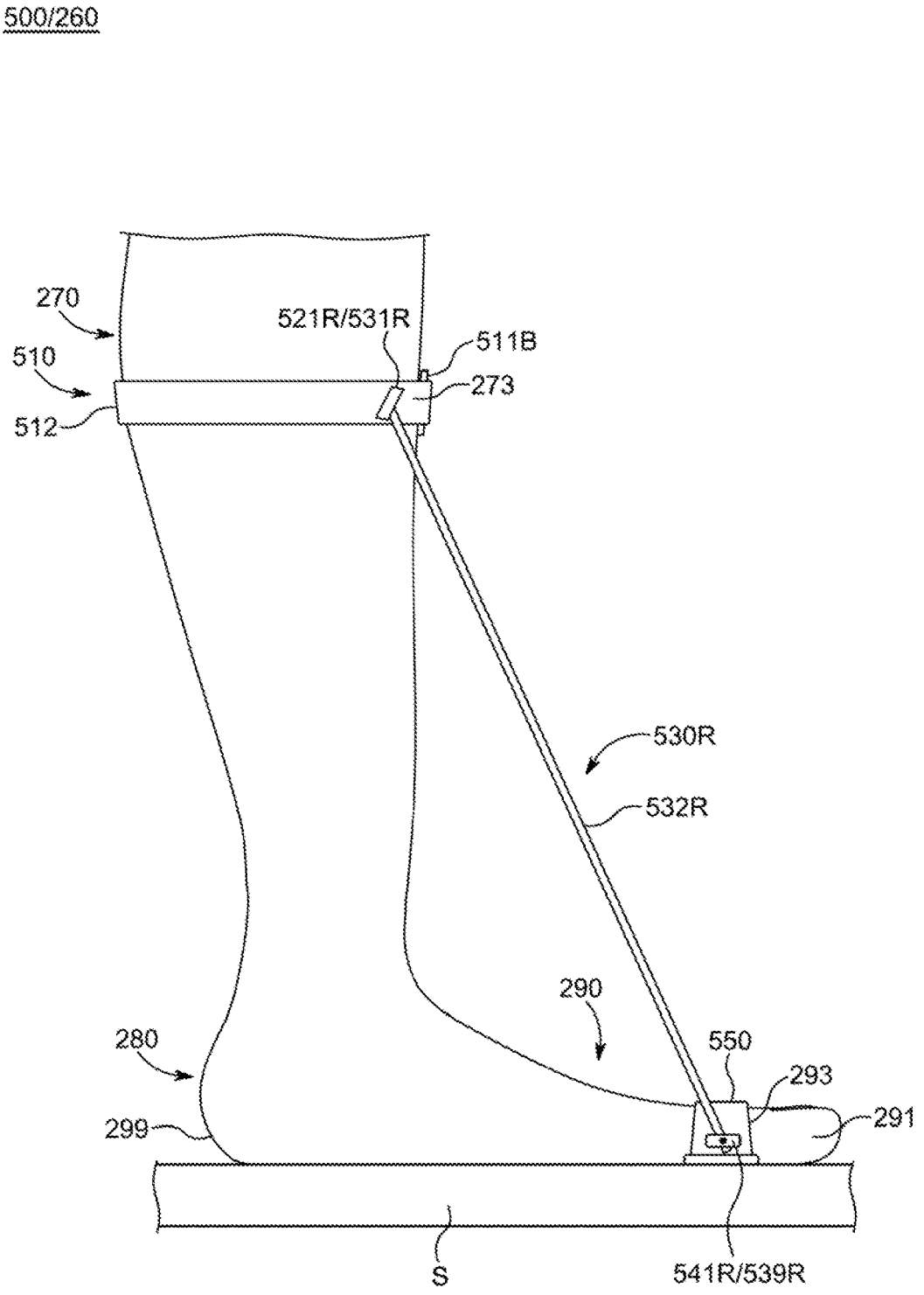
FIG. 15 is a right side elevational view, similar to FIGS. 8-11 and 13, of yet another exercise apparatus, in a second stage of use, similar to the stage of use of FIGS. 8 and 12-14, according to some embodiments.
Figure 16:
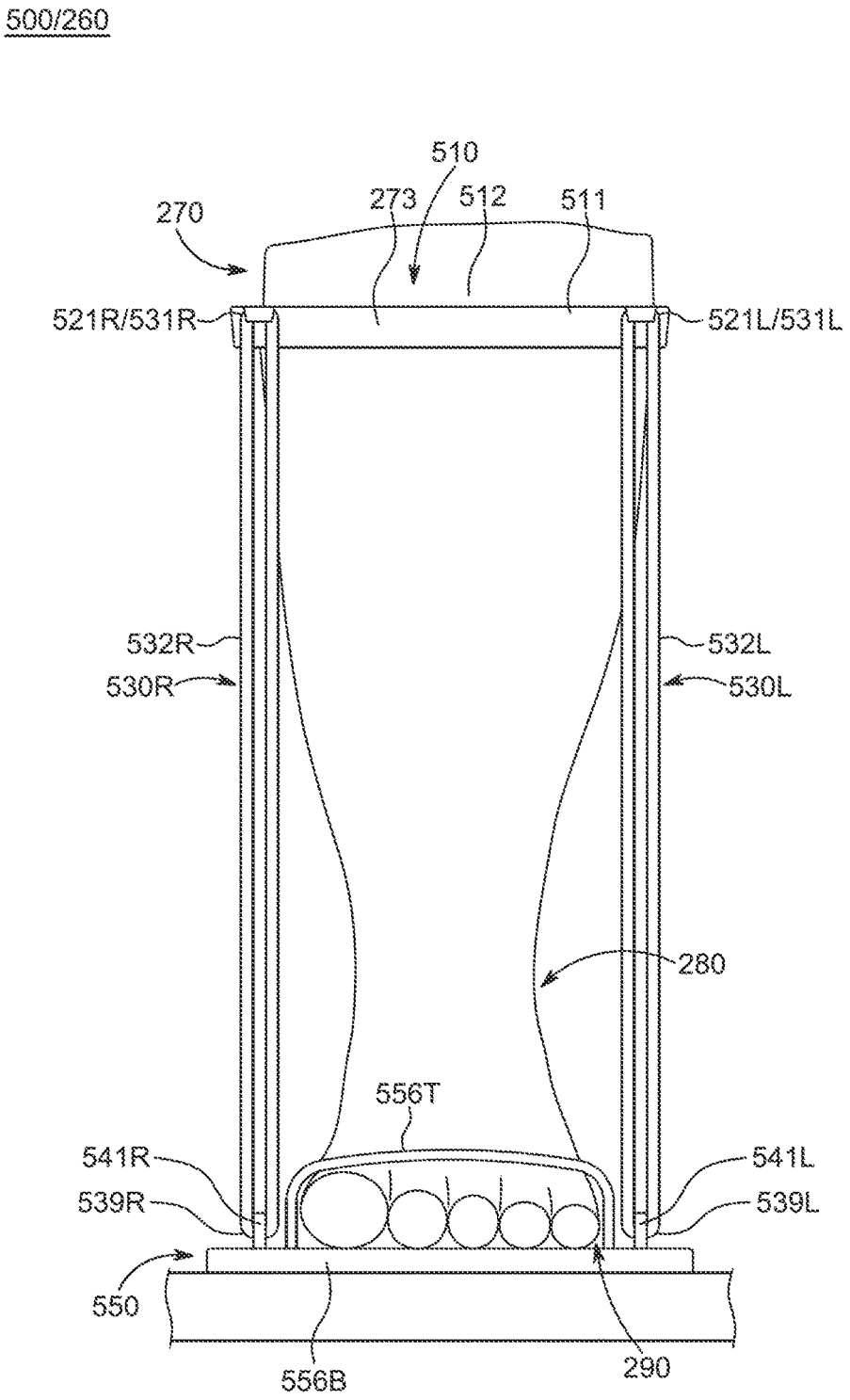
FIG. 16 is a front elevational view, similar to FIGS. 12 and 14, of the exercise apparatus of FIG. 15, in the second stage of use of FIG. 15, according to some embodiments.
Figure 17:
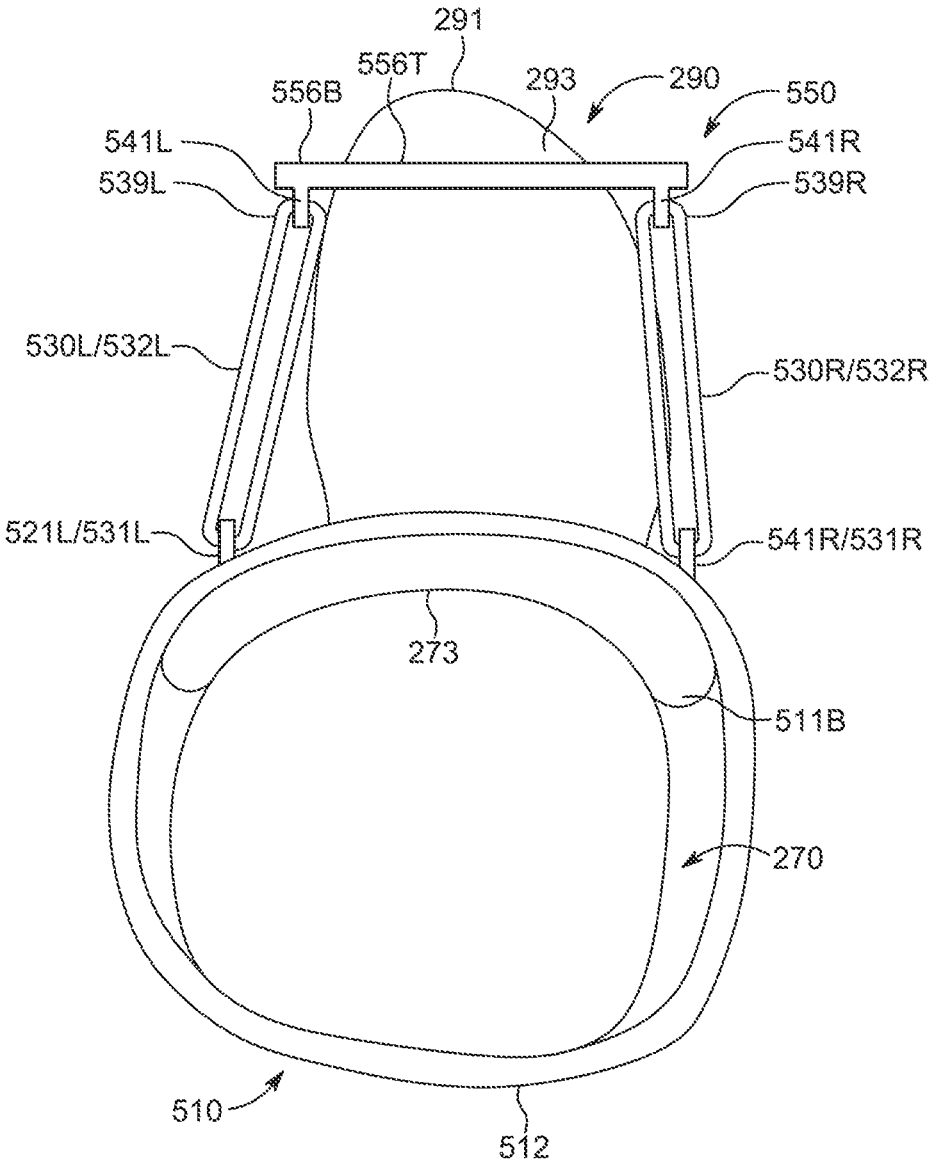
FIG. 17 is a top view, similar to FIG. 4, of the exercise apparatus of FIGS. 15 and 16, in the second stage of use of FIGS. 15 and 16, according to some embodiments.

FIG. 15 is a right side elevational view, similar to FIGS. 8-11 and 13, of yet another exercise apparatus 500, in a second stage of use, similar to the stage of use of FIGS. 8 and 12-14, while FIG. 16 is a front elevational view, similar to FIGS. 12 and 14, of exercise apparatus 500, in the second stage of use of FIG. 15, while FIG. 17 is a top view, similar to FIG. 4, of exercise apparatus 500, in the second stage of use of FIGS. 15 and 16. Apparatus 500 of FIGS. 15-17 may be similar to apparatus 200 of FIGS. 2-11 but may include at least one link body fixedly coupled to each of an anchor component and a base component. Apparatus 500 of FIGS. 15-17 may include similar components to apparatus 200 of FIGS. 2-11, with components of apparatus 500 of FIGS. 15-17 being labeled with "5xx" reference labels that may correspond to the "2xx" reference labels of the labeled components of apparatus 200 of FIGS. 2-11, where differences therebetween may be described below.

As shown, apparatus 500 may include an anchor component 510, a base component 550, and a link component 530. Anchor component 510 may include an anchor body 511 that may be operative to extend along at least a portion of user limb 260 when anchor component 510 is coupled thereto (e.g., at location 273 along at least a portion of first limb portion 270). Additionally or alternatively, anchor component 510 may also a limb attachment component 512 that may be operative to couple anchor component 510 (e.g., anchor body 511) to user limb 260 (e.g., at location 273 of first limb portion 270). Limb attachment component 512 may be any suitable mechanism, such as a strap, and may provide the geometry for most if not all of anchor body 511. A back anchor body portion 511*b* may provide padding for comfort to user limb 260 when anchor component 510 is coupled thereto for being worn by the user.

A base component 550 may include a base body 555 with top and bottom base surfaces 556T and 556B as well as left and right base side surfaces 554L and 554R, each of which may generally extend between a back base end 552B and a front base end 552F for forming the structure of base body 555. As shown, base body 555 may be operative to surround, support, or otherwise contact at least a portion second limb portion 290 (e.g., at limb end 291, such as about a toe or ball region of a foot (e.g., at or near position 293) from underneath the foot and about a side or sides of the foot and/or over a portion of the top of the foot). Apparatus 500 may or may not include at least one support component (not shown) for heling to preventing anchor component 510 from moving with respect to first limb position 273 when anchor component 510 is coupled to first limb portion 270.

Link component 530 of apparatus 500 may include at least one link body (e.g., left link body 532L and/or right link body 532R) extending between a first link portion (e.g., first left link portion 531L and/or first right link portion 531R, respectively) and a second link portion (e.g., second left link portion 539L and/or second right link portion 539R, respectively). At least a portion of each link body may include an elastic portion, for example, similar to elastic portion 134 of apparatus 100. As shown, one, some, or each first link portion (e.g., first left link portion 531L and/or first right link portion 531R) may be coupled to first limb portion 270 of user limb 260 at or about first limb position 273 via anchor component 510 when anchor component 510 is coupled to first limb portion 270 at or about first limb position 273, where, for example, a link portion may be coupled to anchor component 510 via any suitable link anchor retention mechanism(s) of anchor component 510 (e.g., left anchor retention mechanism 521L and/or right anchor retention mechanism 521R). For example, as shown in FIGS. 15-17, link body 532L may be a closed loop (e.g., an at least partially elastic or deformable loop, such as a rubber band or other suitable material(s)), and associated link anchor retention mechanism 521L may be a closed ring (e.g., a metal or plastic or otherwise structurally rigid ring) through which first left link portion 53 IL of link body 532L may be passed (e.g., by a manufacturer) for securing (e.g., unremovably or fixedly coupling) link body 532L of link component 530 to anchor component 510. Additionally or alternatively, as another example, as also shown in FIGS. 15-17, link body 532R may be a closed loop (e.g., an at least partially elastic or deformable loop, such as a rubber band or other suitable material(s)), and associated link anchor retention mechanism 521R may be a closed ring (e.g., a metal or plastic or otherwise structurally rigid ring) through which first right link portion 531R of link body 532R may be passed (e.g., by a manufacturer) for securing (e.g., unremovably or fixedly coupling) link body 532R of link component 530 to anchor component 510. Additionally or alternatively, in some embodiments, another portion of one, some, or each link body (e.g., second left link portion 539L and/or second right link portion 539R, respectively) may be coupled to second limb portion 290 at or about second limb position 293 via base component 550 when base component 550 is coupled to second limb portion 290 at or about second limb position 293, where, for example, a second link portion may be coupled to base component 550 via any suitable link base retention mechanism(s) of base component 550. For example, as shown in FIGS. 15-17, left link body 532L of link component 530 may be a closed loop (e.g., an at least partially elastic or deformable loop, such as a rubber band or other suitable material(s)), and an associated link base retention mechanism 541L may be a closed ring (e.g., a metal or plastic or otherwise structurally rigid ring) through which second left link portion 539L of link body 532L may be passed (e.g., by a manufacturer) for securing (e.g., unremovably or fixedly coupling) link body 532L of link component 530 to base component 550. Additionally or alternatively, as another example, as also shown in FIGS. 15-17, right link body 532R of link component 530 may be a closed loop (e.g., an at least partially elastic or deformable loop, such as a rubber band or other suitable material(s)), and an associated link base retention mechanism 541R may be a closed ring (e.g., a metal or plastic or otherwise structurally rigid ring) through which second right link portion 539R of link body 532R may be passed (e.g., by a manufacturer) for securing (e.g., unremovably or fixedly coupling) link body 532R of link component 530 to base component 550. Alternatively, although not shown in FIGS. 15-17, rather than two link bodies 532L and 532R and a base component 550, link component 530 may include a single base body that may be coupled to anchor component 510 and that may be removably coupled to second limb portion 290 (e.g., similarly to base body 432C of apparatus 400), such that no base component may be needed at all. Such apparatus 500 of FIGS. 15-17 may otherwise be used similarly to apparatus 200 of FIGS. 2-11.

It is to be understood that different features of different embodiments of apparatus 100, apparatus 200, apparatus 300, apparatus 400, and apparatus 500 may be combined to form any suitable exercise apparatus for use by any suitable user limb 160. For example, any suitable number of link bodies may be fixedly or removably coupled to an anchor component and/or a base component using any suitable coupling mechanism. In some embodiments, at least one portion of each link body may be coupled to at least one of an anchor component and a base component at all times such that that link body may not be easily misplaced. Any suitable number of link bodies of any suitable elastic modulus or different elastic moduli may be provided for enabling various subsets to be coupled to both first and second limb portions of the user for varying the resistance provided by the exercise apparatus during use. Only a portion of a link body may be elastic while another portion may be non-elastic. Alternatively, the entirety of a link body may be elastic.

Figure 18:
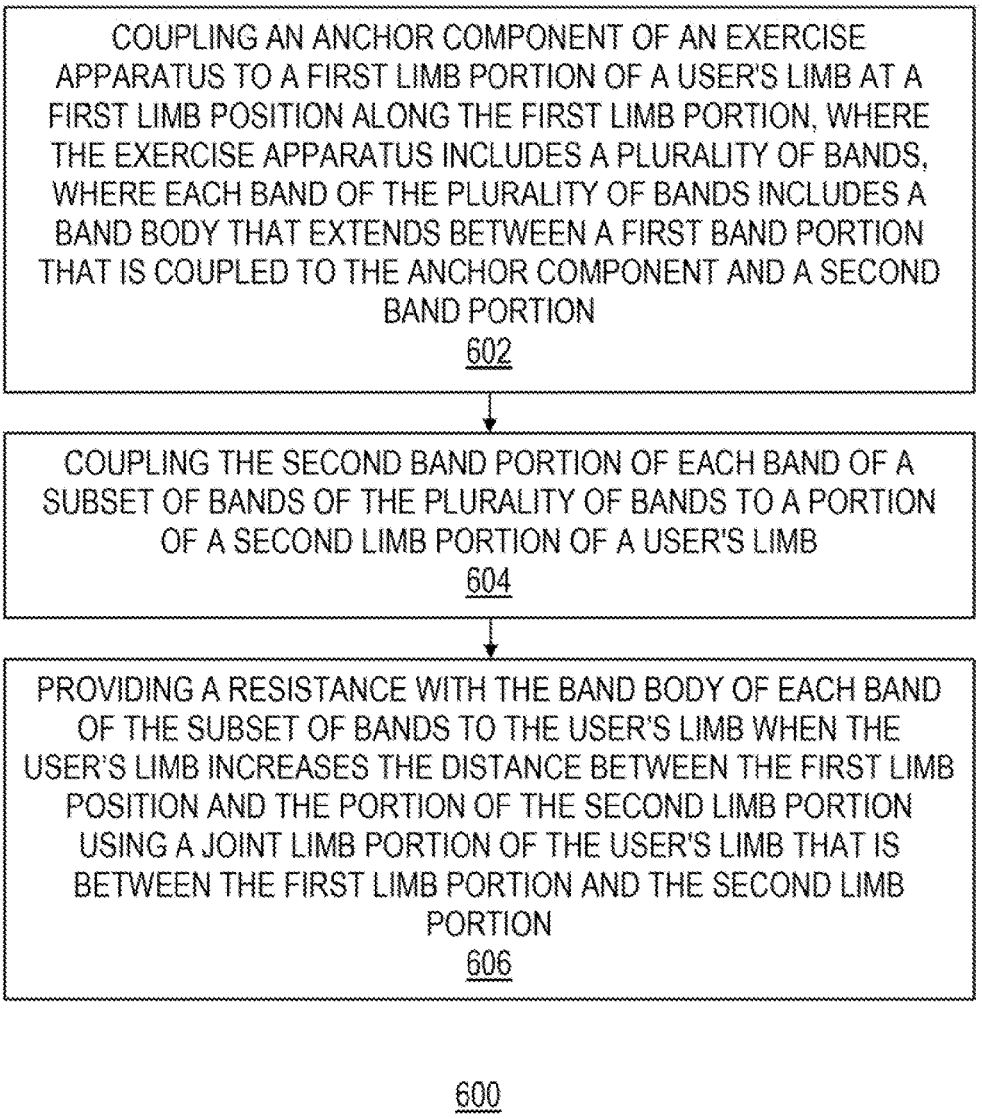
FIG. 18 is a flowchart of an illustrative process for exercising a user's limb using exercise apparatus.

FIG. 18 is a flowchart of an illustrative process 600 for exercising a user's limb using exercise apparatus. At step 602, process 600 may include coupling an anchor component of an exercise apparatus to a first limb portion of a user's limb at a first limb position along the first limb portion, where the exercise apparatus includes a plurality of bands, where each band of the plurality of bands includes a band body that extends between a first band portion that is coupled to the anchor component and a second band portion. For example, as shown in FIGS. 8-10, anchor component 210 of exercise apparatus 200 may be coupled to first limb portion 270 of user's limb 260 at first limb position 273 along first limb portion 270, where apparatus 200 may include link component 230 with multiple link bands (e.g., link bands 232R, 232L, and 232C, each of which may extend between a first band portion coupled to anchor component 210 (e.g., at portions 231R, 231L, and 231C coupled to respective mechanisms 221R, 221L, and 221C) and a second band portion (e.g., portions 239R, 239L, and 239C)). At step 604, process 600 may include coupling the second band portion of each band of a subset of bands of the plurality of bands to a portion of a second limb portion of a user's limb. For example, as described above with respect to FIGS. 8-10, any subset of second portions 231R, 231L, and 231C of link bodies 232R, 232L, and 232C may be coupled to second limb portion 290 of user's limb 260 (e.g., at position 293, directly or via a base component). Next, at step 606, after steps 602 and 604, process 600 may include providing a resistance with the band body of each band of the subset of bands to the user's limb when the user's limb increases the distance between the first limb position and the portion of the second limb portion using a joint limb portion of the user's limb that is between the first limb portion and the second limb portion. For example, as described above with respect to FIGS. 8-10, each link body that may be extending between first limb position 273 (e.g., via anchor component 210) and second limb position 293 (e.g., via base component 250) may provide a resistance to limb 260 when limb 260 increases the distance between first limb position 273 and second limb position 293 using joint limb portion 280. In some embodiments, after step 606, process 600 may then include coupling the second band portion of each band of another subset of bands of the plurality of bands to the portion of the second limb portion, and, after the coupling of the second band portion of each band of the other subset, providing another resistance with the band body of each band of the other subset of bands to the user's limb when the user's limb increases the distance between the first limb position and the portion of the second limb portion using the joint limb portion, wherein the other subset is different than the subset and the other resistance is different than the resistance.

It is understood that the steps shown in process 600 of FIG. 18 are merely illustrative and that existing steps may be modified or omitted, additional steps may be added, and the order of certain steps may be altered.

While there have been described apparatus and methods for exercising a limb of a user, it is to be understood that many changes may be made therein without departing from the spirit and scope of the subject matter described herein in any way. Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

Therefore, those skilled in the art will appreciate that the invention can be practiced by other than the described embodiments, which are presented for purposes of illustration rather than of limitation.

What is claimed is:

1. Apparatus for use on a user's leg with respect to a stationary surface, wherein the user's leg comprises a cnemis, a foot, and an ankle joint that couples the cnemis to the foot, the apparatus comprising:

an anchor component operative to be coupled to the cnemis at a first cnemis location along a length of the cnemis;

a base component comprising a base body extending between a first base end and a second base end, the base body operative to be positioned between the foot and the stationary surface;

an extender component comprising an extender body extending between a first extender portion that is coupled to the anchor component and a second extender portion that is coupled to the base component; and an elastic band comprising:

a first portion of the elastic band that is operative to be coupled to the anchor component; and a second portion of the elastic band that is operative to be coupled to the base component, wherein:

when the anchor component is coupled to the cnemis at the first cnemis location and the base body is positioned between the foot and the stationary surface and the first portion of the elastic band is coupled to the anchor component and the second portion of the elastic band is coupled to the base component, an elastic portion of the elastic band is operative to provide resistance when the foot attempts to push the second base end towards the stationary surface;

the elastic band is a closed loop;

the first portion of the elastic band is coupled to the anchor component by passing through a closed ring of the anchor component; and the second portion of the elastic band is operative to be removably coupled to the base component by looping under a portion of the base body such that the second portion of the elastic band is positioned between the base body and the stationary surface.

2. The apparatus of claim 1, wherein the second extender portion is rotatably coupled to the base component so that the base body is operative to rotate with respect to the extender body about an axis of rotation.

3. The apparatus of claim 2, wherein the base body is operative to rotate with respect to the extender body about the axis of rotation to a first orientation so that at least a portion of the base body contacts a portion of the anchor component.

4. The apparatus of claim 3, wherein at least one of the anchor component and the elastic band is operative to hold the base body at the first orientation when the base body is not positioned between the foot and the stationary surface.

5. The apparatus of claim 1, wherein the apparatus further comprises another elastic band comprising:

a first portion of the other elastic band that is operative to be coupled to the anchor component; and a second portion of the other elastic band that is operative to be coupled to the base component.

6. The apparatus of claim 5, wherein:

when the anchor component is coupled to the cnemis at the first cnemis location and the base body is positioned between the foot and the stationary surface and the first portion of the elastic band is coupled to the anchor component and the first portion of the other elastic band is coupled to the anchor component and the second portion of the elastic band is coupled to the base component and the second portion of the other elastic band is coupled to the anchor component, the elastic band and the other elastic band are operative to provide a first resistance when the foot attempts to push the second base end towards the stationary surface;

when the anchor component is coupled to the cnemis at the first cnemis location and the base body is positioned between the foot and the stationary surface and the first portion of the elastic band is coupled to the anchor component and the first portion of the other elastic band is coupled to the anchor component and the second portion of the elastic band is coupled to the base component and the second portion of the other elastic band is not coupled to the anchor component, the elastic band is operative to provide a second resistance when the foot attempts to push the second base end towards the stationary surface; and the second resistance is less than the first resistance.

7. The apparatus of claim 1, wherein the extender body prevents the anchor component from moving away from the first cnemis location when the anchor component is coupled to the cnemis at the first cnemis location and the base body is positioned between the foot and the stationary surface.

8. The apparatus of claim 1, wherein:

the second extender portion is coupled to the base component proximate the first base end; and the second portion of the elastic band is operative to be coupled to the base component proximate the second base end.

9. The apparatus of claim 1, wherein:

the first extender portion is coupled to a first side of the anchor component;

the apparatus further comprises another extender component comprising another extender body extending between another first extender portion that is coupled to a second side of the anchor component and another second extender portion that is coupled to the base component; and when the anchor component is coupled to the cnemis at the first cnemis location, the first side of the anchor component is adjacent a first side of the cnemis and the second side of the anchor component is adjacent a second side of the cnemis that is opposite the first side of the cnemis.

10. The apparatus of claim 1, wherein:

the apparatus further comprises another elastic band that is a closed loop;

a first portion of the other elastic band is coupled to the anchor component by passing through a second closed ring of the anchor component; and a second portion of the other elastic band is operative to be removably coupled to the base component by looping about a portion of a hook of the base component.

11. The apparatus of claim 1, wherein the portion of the base body comprises a channel along a bottom surface of the base component for retaining at least a portion of the second portion of the elastic band when the second portion of the elastic band is coupled to the base component.

12. The apparatus of claim 1, wherein, when the anchor component is coupled to the cnemis at the first cnemis location and the base body is positioned between the foot and the stationary surface and the foot holds the first base end against the stationary surface and the first portion of the elastic band is coupled to the anchor component and the second portion of the elastic band is coupled to the base component, the elastic portion of the elastic band is operative to provide resistance when the foot attempts to push the second base end towards the stationary surface.

13. A method for exercising a user's limb using an exercise apparatus that comprises an anchor component and a plurality of bands, wherein each band of the plurality of bands comprises a band body that extends between a first band portion that is coupled to the anchor component and a second band portion, wherein the user's limb comprises a first limb portion, a second limb portion, and a joint limb portion between the first limb portion and the second limb portion, wherein the first limb portion is a cnemis, wherein the second limb portion is a foot, wherein the joint limb portion is an ankle joint, and wherein the method comprises:

coupling the anchor component to the first limb portion at a first limb position along the first limb portion;

coupling the second band portion of each band of a subset of bands of the plurality of bands to the second limb portion by looping the second band portion of each band of the subset of bands about the second limb portion, such that the second band portion of every band of the subset of bands of the plurality of bands is the only portion of the plurality of bands coupled to the the second limb portion; and after both of the couplings, providing a resistance with the band body of each band of the subset of bands of the plurality of bands to the user's limb when the user's limb increases the distance between the first limb position and a portion of the second limb portion using the joint limb portion.

14. The method of claim 13, further comprising:

after the providing, coupling the second band portion of each band of another subset of bands of the plurality of bands to the second limb portion, such that the second band portion of every band of the other subset of bands of the plurality of bands is the only portion of the plurality of bands coupled to the the second limb portion; and after the coupling of the second band portion of each band of the other subset and while the anchor component remains coupled to the first limb portion at the first limb position along the first limb portion, providing another resistance with the band body of each band of the other subset of bands of the plurality of bands to the user's limb when the user's limb increases the distance between the first limb position and the portion of the second limb portion using the joint limb portion, wherein:

the other subset is different than the subset; and the other resistance is different than the resistance.

* * * * *